US011718941B2

(12) United States Patent
Gotoh et al.

(10) Patent No.: US 11,718,941 B2
(45) Date of Patent: Aug. 8, 2023

(54) EMBROIDERY APPARATUS, DYEING/EMBROIDERY SYSTEM, AND METHOD FOR ADJUSTING CONSUMPTION AMOUNT OF THREAD

(71) Applicants: Yuuki Gotoh, Kanagawa (JP); Shinya Tanaka, Kanagawa (JP); Taito Omura, Kanagawa (JP); Yusuke Komine, Kanagawa (JP)

(72) Inventors: Yuuki Gotoh, Kanagawa (JP); Shinya Tanaka, Kanagawa (JP); Taito Omura, Kanagawa (JP); Yusuke Komine, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 17/449,476

(22) Filed: Sep. 30, 2021

(65) Prior Publication Data

US 2022/0106720 A1 Apr. 7, 2022

(30) Foreign Application Priority Data

Oct. 2, 2020 (JP) ..... 2020-167666
Jul. 30, 2021 (JP) ..... 2021-126024

(51) Int. Cl.
*D05C 11/24* (2006.01)
*D05C 5/02* (2006.01)
(Continued)

(52) U.S. Cl.
CPC ..... *D05C 11/24* (2013.01); *D05C 5/02* (2013.01); *D05C 11/08* (2013.01); *D05C 11/18* (2013.01); *D05C 11/20* (2013.01)

(58) Field of Classification Search
CPC ..... D05C 11/24; D05C 11/16; D05C 11/20; D05C 11/08; D05B 67/00
See application file for complete search history.

(56) References Cited

U.S. PATENT DOCUMENTS 4,465,005 A * 8/1984 Eguchi ..... D06B 11/0026 112/270
4,538,535 A * 9/1985 Hanyu ..... D06B 3/045 112/80.71
(Continued)

FOREIGN PATENT DOCUMENTS

JP H05-025519 4/1993
JP H06-304359 11/1994
(Continued)

OTHER PUBLICATIONS

Extended European Search Report for 21199904.0 dated Feb. 21, 2022.

*Primary Examiner* — Danny Worrell
(74) *Attorney, Agent, or Firm* — IPUSA, PLLC

(57) ABSTRACT

An embroidery apparatus is configured to perform an embroidery operation according to embroidery data. The embroidery apparatus includes a thread assumed consumption amount calculator configured to calculate an assumed consumption amount of a thread in the embroidery operation, based on initial embroidery data input in advance; a thread consumption amount detection mechanism configured to detect an actual consumption amount of the thread; and a thread consumption amount adjuster configured to adjust the actual consumption amount of the thread in the embroidery operation by adjusting output embroidery data to be output, based on a difference between the calculated assumed consumption amount of the thread and the detected actual consumption amount of the thread.

15 Claims, 22 Drawing Sheets

(51) Int. Cl.

| | |
|---|---|
| ***D05C 11/08*** | (2006.01) |
| ***D05C 11/18*** | (2006.01) |
| ***D05C 11/20*** | (2006.01) |

(56) References Cited

U.S. PATENT DOCUMENTS

| | | | | |
|---|---|---|---|---|
| 4,886,515 | A * | 12/1989 | Kinnebrew, II ..... | D05B 67/00 8/151.2 |
| 6,189,989 | B1 | 2/2001 | Hirabayashi et al. | |
| 6,401,641 | B1 * | 6/2002 | Miyano ..... | D05B 67/00 112/470.05 |
| 10,723,158 | B2 | 7/2020 | Toda et al. | |
| 10,974,522 | B2 | 4/2021 | Ikegami | |
| 2007/0245940 | A1 | 10/2007 | Wahlstrom | |
| 2018/0171520 | A1 | 6/2018 | Eklind et al. | |
| 2020/0171846 | A1 | 6/2020 | Hayashi et al. | |
| 2020/0171854 | A1 | 6/2020 | Sunaoshi et al. | |
| 2020/0276839 | A1 | 9/2020 | Satoh et al. | |
| 2021/0023837 | A1 | 1/2021 | Nagasu et al. | |

FOREIGN PATENT DOCUMENTS

| | | |
|---|---|---|
| JP | H07-100094 | 11/1995 |
| JP | 3066937 | 7/2000 |
| JP | 2002-102561 | 4/2002 |
| JP | 2004-201946 | 7/2004 |
| JP | 2007-301733 | 11/2007 |
| JP | 2008-289522 | 12/2008 |
| JP | 2009-114551 | 5/2009 |
| JP | 2009-273675 | 11/2009 |
| JP | 2015-168705 | 9/2015 |
| JP | 2018-525548 | 9/2018 |

* cited by examiner

| | | | |
|---|---|---|---|
| (L1) INITIAL EMBROIDERY DATA | INTERVAL=0.3 mm<br>WIDTH=10 mm | | |
| (L2) NEEDLE THREAD CONSUMPTION STATE | (C1) WHEN CONSUMPTION AMOUNT IS SMALL<br>PREDICTED CONSUMPTION AMOUNT − ACTUAL CONSUMPTION AMOUNT ≦ −10 mm | (C2) WHEN CONSUMPTION SUBSTANTIALLY MATCHES PREDICTION (WHEN NOT CORRECTED)<br>−10 mm ≦ PREDICTED CONSUMPTION AMOUNT − ACTUAL CONSUMPTION AMOUNT ≦ 10 mm | (C3) WHEN CONSUMPTION AMOUNT IS LARGE<br>10 mm ≦ PREDICTED CONSUMPTION AMOUNT − ACTUAL CONSUMPTION AMOUNT |
| (L3) WIDTH AFTER CHANGE | 10 mm | 10 mm | 10 mm |
| (L4) INTERVAL AFTER CHANGE | 0.2 mm | 0.3 mm | 0.4 mm |
| (L5) STATE THAT OCCURS WITHOUT ADJUSTMENT | t1 t2 | t1 t2 | t1 t2 |
| (L6) STATE AFTER ADJUSTMENT | t1 t2' | t1 t2' | t1 t2' |

FIG.9

FIG.10

| | | | |
|---|---|---|---|
| (L1) INITIAL EMBROIDERY DATA | INTERVAL=0.3 mm<br>WIDTH=10 mm | | |
| (L2) NEEDLE THREAD CONSUMPTION STATE | (C1)<br>WHEN CONSUMPTION AMOUNT IS SMALL<br>PREDICTED CONSUMPTION AMOUNT − ACTUAL CONSUMPTION AMOUNT ≦ −10 mm | (C2)<br>WHEN CONSUMPTION SUBSTANTIALLY MATCHES PREDICTION (WHEN NOT CORRECTED)<br>−10 mm ≦ PREDICTED CONSUMPTION AMOUNT − ACTUAL CONSUMPTION AMOUNT ≦ 10 mm | (C3)<br>WHEN CONSUMPTION AMOUNT IS LARGE<br>10 mm ≦ PREDICTED CONSUMPTION AMOUNT − ACTUAL CONSUMPTION AMOUNT |
| (L3) WIDTH AFTER CHANGE | 11 mm | 10 mm | 9 mm |
| (L4) INTERVAL AFTER CHANGE | 0.3 mm | 0.3 mm | 0.3 mm |
| (L5) STATE THAT OCCURS WITHOUT ADJUSTMENT | t1 t2 | t1 t2 | t1 t2 |
| (L6) STATE AFTER ADJUSTMENT | t1 t2' | t1 t2' | t1 t2' |

EMBROIDERY OF CIRCLE

BASE SEWING

FIG.13

| | | | |
|---|---|---|---|
| (L1) INITIAL EMBROIDERY DATA | 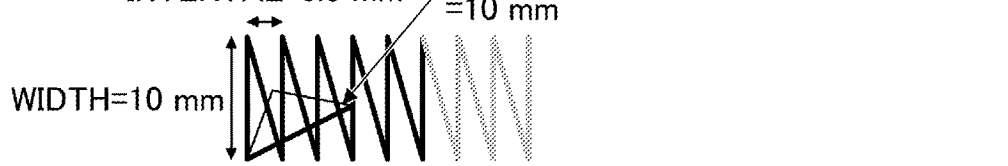 | | |
| (L2) NEEDLE THREAD CONSUMPTION STATE | (C1) WHEN CONSUMPTION AMOUNT IS SMALL<br>PREDICTED CONSUMPTION AMOUNT − ACTUAL CONSUMPTION AMOUNT ≦ −10 mm | (C2) WHEN CONSUMPTION SUBSTANTIALLY MATCHES PREDICTION (WHEN NOT CORRECTED)<br>−10 mm ≦ PREDICTED CONSUMPTION AMOUNT − ACTUAL CONSUMPTION AMOUNT ≦ 10 mm | (C3) WHEN CONSUMPTION AMOUNT IS LARGE<br>10 mm ≦ PREDICTED CONSUMPTION AMOUNT − ACTUAL CONSUMPTION AMOUNT |
| (L3) WIDTH AFTER CHANGE | 10 mm | 10 mm | 10 mm |
| (L4) INTERVAL AFTER CHANGE | 0.3 mm | 0.3 mm | 0.3 mm |
| (L5) AMOUNT OF BASE SEWING THREAD | 12 mm | 10 mm | 8 mm |
| (L6) STATE THAT OCCURS WITHOUT ADJUSTMENT | 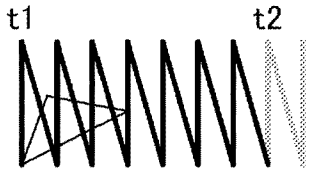 | 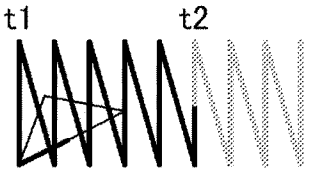 | 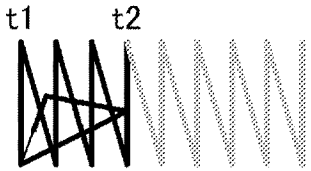 |
| (L7) STATE AFTER ADJUSTMENT | 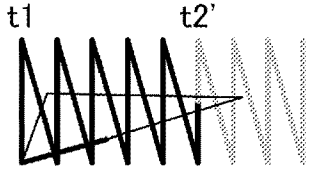 | 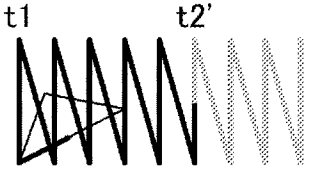 | 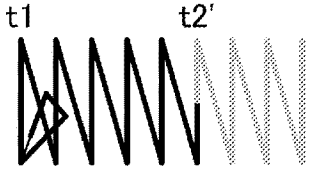 |

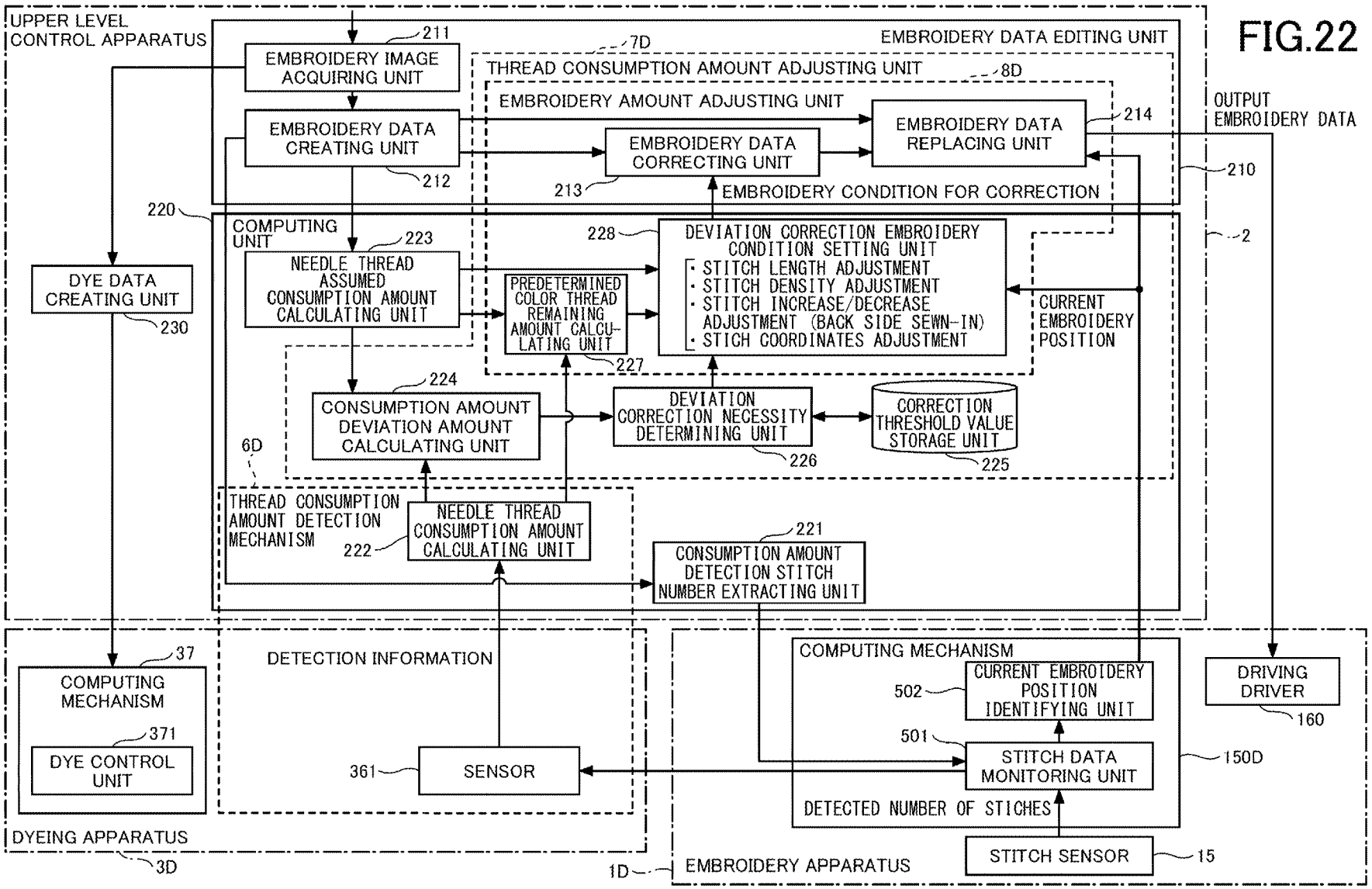
FIG.22
OUTPUT EMBROIDERY DATA
210
2
DRIVING DRIVER
160
150D
15
EMBROIDERY DATA EDITING UNIT
8D
214
EMBROIDERY DATA REPLACING UNIT
CURRENT EMBROIDERY POSITION
CURRENT EMBROIDERY POSITION IDENTIFYING UNIT
STITCH DATA MONITORING UNIT
STITCH SENSOR
COMPUTING MECHANISM
502
501
DETECTED NUMBER OF STICHES
EMBROIDERY CONDITION FOR CORRECTION
DEVIATION CORRECTION EMBROIDERY CONDITION SETTING UNIT
· STITCH LENGTH ADJUSTMENT
· STITCH DENSITY ADJUSTMENT
· STITCH INCREASE/DECREASE ADJUSTMENT (BACK SIDE SEWN-IN)
· STICH COORDINATES ADJUSTMENT
CORRECTION THRESHOLD VALUE STORAGE UNIT
225
EMBROIDERY AMOUNT ADJUSTING UNIT
EMBROIDERY DATA CORRECTING UNIT
213
228
DEVIATION CORRECTION NECESSITY DETERMINING UNIT
226
CONSUMPTION AMOUNT DETECTION STITCH NUMBER EXTRACTING UNIT
221
EMBROIDERY APPARATUS
1D
7D
THREAD CONSUMPTION AMOUNT ADJUSTING UNIT
PREDETERMINED COLOR THREAD REMAINING AMOUNT CALCULATING UNIT
227
NEEDLE THREAD CONSUMPTION AMOUNT CALCULATING UNIT
EMBROIDERY IMAGE ACQUIRING UNIT
211
EMBROIDERY DATA CREATING UNIT
212
223
NEEDLE THREAD ASSUMED CONSUMPTION AMOUNT CALCULATING UNIT
224
CONSUMPTION AMOUNT DEVIATION AMOUNT CALCULATING UNIT
COMPUTING UNIT
6D
THREAD CONSUMPTION AMOUNT DETECTION MECHANISM
222
DETECTION INFORMATION
SENSOR
361
UPPER LEVEL CONTROL APPARATUS
220
DYE DATA CREATING UNIT
230
37
COMPUTING MECHANISM
371
DYE CONTROL UNIT
DYEING APPARATUS
3D

EMBROIDERY APPARATUS, DYEING/EMBROIDERY SYSTEM, AND METHOD FOR ADJUSTING CONSUMPTION AMOUNT OF THREAD

CROSS-REFERENCE TO RELATED APPLICATION

The present application is based on and claims priority under 35 U.S.C. § 119 to Japanese Patent Application No. 2020-167666, filed on Oct. 2, 2020, and Japanese Patent Application No. 2021-126024, filed on Jul. 30, 2021, the contents of which are incorporated herein by reference in their entirety.

BACKGROUND OF THE INVENTION

1. Field of the Invention

The present invention relates to an embroidery apparatus, a dyeing/embroidery system, and a method for adjusting the consumption amount of thread.

2. Description of the Related Art

In embroidery apparatuses, it is known that the tension balance of the needle thread (upper thread) and the bobbin thread (lower thread) changes due to various factors, and the balance of the consumption amount of the needle thread and the bobbin thread changes.

Accordingly, in Patent Document 1, a technique for detecting the consumption amount of the needle thread is proposed in order to identify a defect beforehand, such as running out of thread due to a change in the consumption amount of the thread.

However, in Patent Document 1, the thread consumption amount can be predicted, but the thread consumption amount cannot be corrected according to the situation of embroidery.

On the other hand, in Patent Document 2, as a control technique of the embroidery apparatus, when embroidery is performed by using a continuous needle thread including a color change (in which the color is changed), embroidery data is prepared to perform the embroidery so that the point of change between the different colors in the needle thread cannot be seen from the upper side, to perform embroidery so that the point of change between the different colors in the needle thread is not exposed on the front side of the embroidery.

Patent Document 1: Japanese Unexamined Patent Application Publication No. 2004-201946

Patent Document 2: Japanese Unexamined Patent Application Publication No. 2008-289522

SUMMARY OF THE INVENTION

According to one aspect of the present invention, there is provided an embroidery apparatus configured to perform an embroidery operation according to embroidery data, including a thread assumed consumption amount calculator configured to calculate an assumed consumption amount of a thread in the embroidery operation, based on initial embroidery data input in advance; a thread consumption amount detection mechanism configured to detect an actual consumption amount of the thread; and a thread consumption amount adjuster configured to adjust the actual consumption amount of the thread in the embroidery operation by adjusting output embroidery data to be output, based on a difference between the calculated assumed consumption amount of the thread and the detected actual consumption amount of the thread.

BRIEF DESCRIPTION OF THE DRAWINGS

FIG. 9 is a table illustrating a simplified correction example for changing the stitch density as a correction embroidery condition according to the first embodiment of the present invention;

FIG. 10 is a table illustrating a simplified correction example for changing the stitch length as a correction embroidery condition according to the first embodiment of the present invention;

FIG. 13 is a table illustrating a simplified correction example when changing stitches of base sewing as a correction embroidery condition according to the first embodiment of the present invention;

FIG. 22 is a functional block diagram relating to the control of an upper level control apparatus, a dyeing apparatus, and an embroidery apparatus according to the third embodiment of the present invention.

DESCRIPTION OF THE EMBODIMENTS

Figure 1:
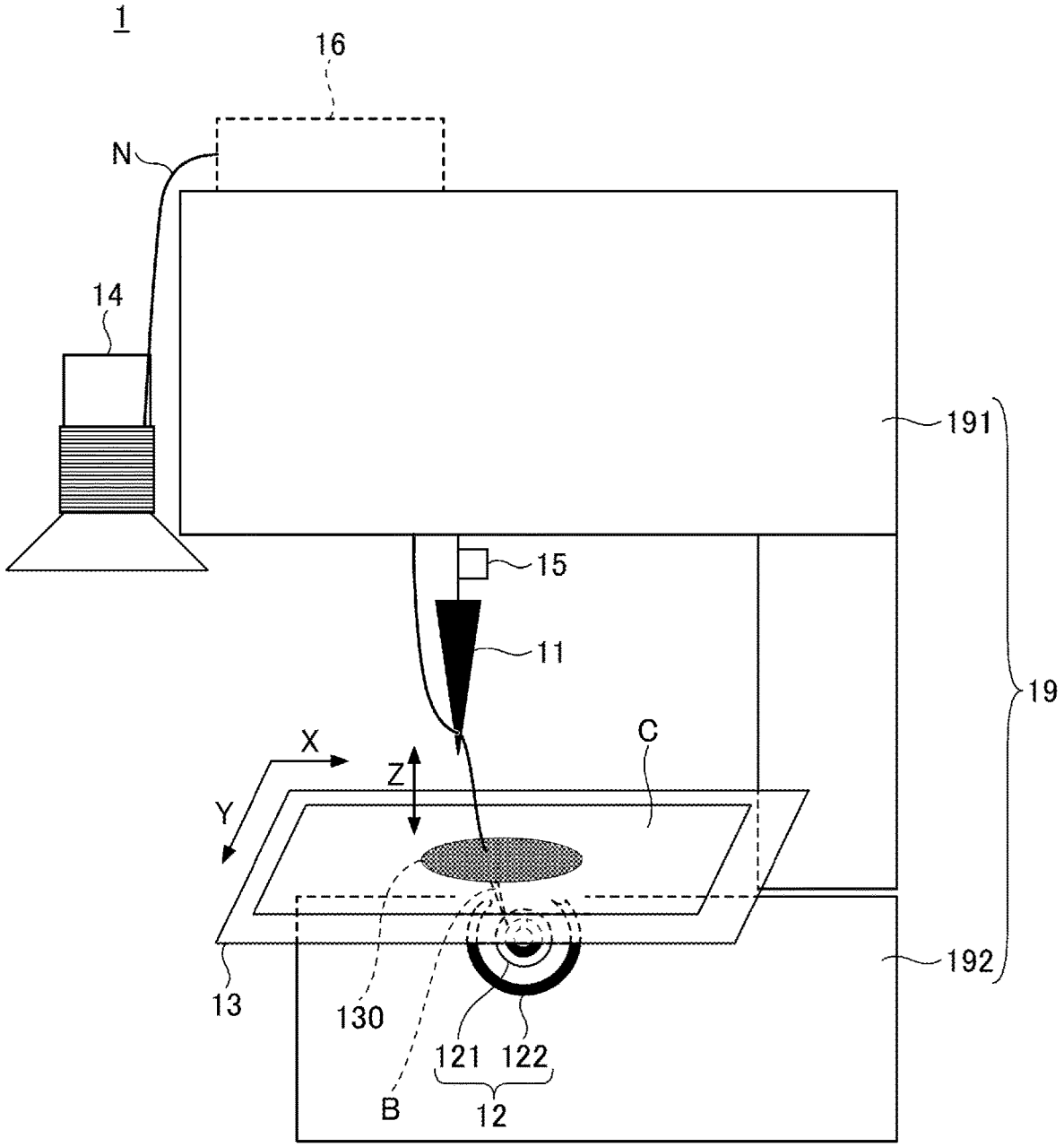
FIG. 1 is a schematic view of an embroidery apparatus according to a first embodiment of the present invention.

Even when embroidery data is created for performing embroidery so that the point of color change of the needle thread cannot be seen from the upper side as in Patent Document 2, subsequently, if the consumption amount of the needle thread changes from the prediction during the embroidery operation, the position of the point of color change will be deviated.

A problem to be addressed by an embodiment of the present invention is to provide an embroidery apparatus that eliminates the positional deviation of the color of embroidery on a cloth during the embroidery operation, even when the actual thread consumption amount is deviated from the assumed amount, when a continuous thread including a color change is used.

Hereinafter, an embodiment for carrying out the present invention will be described with reference to the drawings. In the following drawings, the same elements are denoted by the same reference numerals, and overlapping descriptions may be omitted.

First Embodiment

Figure 2:
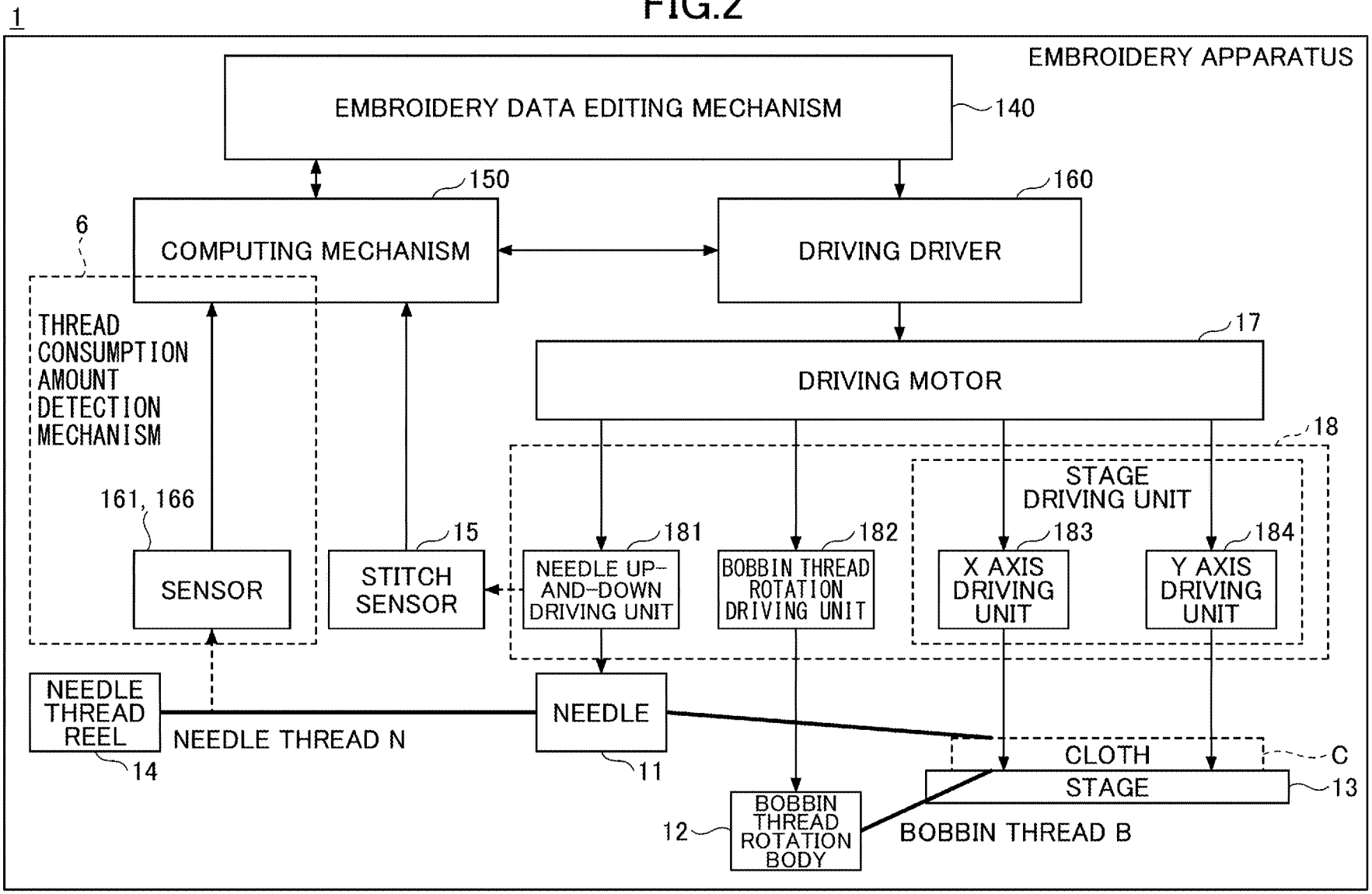
FIG. 2 is a schematic block diagram of an embroidery apparatus according to the first embodiment of the present invention.

First, an embroidery apparatus 1 will be described with reference to FIGS. 1 and 2. FIG. 1 is a schematic diagram of an embroidery apparatus 1 according to a first embodiment of the present invention. FIG. 2 is a schematic block diagram of the embroidery apparatus 1 according to the first embodiment of the present invention.

The embroidery apparatus 1 illustrated in FIG. 1 includes a needle 11, a bobbin thread rotation body 12, a stage 13, a needle thread reel 14, a stitch sensor 15, a needle thread detecting unit 16 of a usage detecting mechanism, and an embroidery body 19.

The needle 11 has a needle hole at the tip of the needle through which a needle thread N (upper thread) passes, and is movable in a vertical direction with respect to a cloth C.

The bobbin thread rotation body 12 has a bobbin thread bobbin 121 that is a bobbin thread supplying means around which a bobbin thread B (lower thread) is wound, and a hook 122, and the bobbin thread bobbin 121 and the hook 122 rotate in conjunction with movement of the needle 11. Although not illustrated, the bobbin thread rotation body 12 is also provided with a cylindrical shuttle body for accommodating the bobbin thread bobbin 121, an outer hook on a cylinder with a base, and a cylindrical case integral with the hook 122. In FIG. 1, the bobbin thread bobbin 121 is an example of a vertical rotation method in which the rotation direction is the vertical direction (vertical full rotation shuttle method, vertical half rotation shuttle method); however, the bobbin thread bobbin 121 may be of a horizontal rotation method in which the rotation direction is the horizontal direction (horizontal shuttle method).

The stage 13 is a base for holding the cloth C, and a hole 130 through which the needle 11 passes is formed. The stage 13 can be moved in the X and Y directions for feeding the cloth.

Hereinafter, the width direction of the embroidery apparatus 1 is referred to as X, the depth direction of the embroidery apparatus 1 is referred to as Y, and the height direction (vertical direction) of the embroidery apparatus 1 is referred to as Z.

The needle thread reel 14 has the needle thread N wound around thereto and is a means for supplying the needle thread N to the needle 11.

The stitch sensor 15 is a sensor for detecting the vertical movement of the needle 11 and is provided, for example, on a needle bar holding the needle 11 to detect the number of stitches corresponding to how many times the needle 11 has been raised or lowered, i.e., how many stitch have progressed.

The needle thread detecting unit 16 of a consumption amount detection mechanism includes a sensor 161 (166) (see FIG. 5), and is a means through which the needle thread N drawn out from the needle thread reel 14 passes, and is a means for detecting a conveyance speed or a conveyance timing of the needle thread N for detecting the actual consumption amount of the needle thread N. The needle thread detecting unit 16 and a part of a computing mechanism 150 form a thread consumption amount detection mechanism 6 (see FIG. 6). The specific configuration of the needle thread detecting unit 16 will be described in detail with reference to FIG. 5.

The embroidery body 19 includes an embroidery head 191 and a lower body 192. The embroidery head 191 is provided with the computing mechanism 150 (see FIG. 2), and by controlling the operation of the needle 11 through which the needle thread N passes (the movement of the needle) and the movement of the stage 13, the embroidery is performed on the cloth C using the needle thread N and the bobbin thread B fed in response to the feed of the needle thread N. The lower body 192 is connected to the embroidery head 191 and is provided with a driving unit that drives the stage 13 and the bobbin thread rotation body 12.

Further, in an embodiment of the present invention, the "thread" including the needle thread and the bobbin thread may be a fiberglass thread, a woolen thread, a cotton thread, a synthetic thread, a metal thread, wool, cotton, a polymer, or mixed metal threads, yarn, filaments, or any linear member (continuous base material) to which liquid can be applied, including braids, straps, and the like.

Referring to FIG. 2, the embroidery apparatus 1 includes, as the portions related to the drive control, an embroidery data editing mechanism 140, the computing mechanism 150, a driving driver 160, a drive motor 17, a needle up-and-down driving unit 181, a bobbin thread rotation driving unit 182, an X axis driving unit 183, and a Y axis driving unit 184. At least the driving driver 160, the drive motor 17, and the needle up-and-down driving unit 181 are built in the embroidery head 191 on the upper side of the needle 11. The embroidery data editing mechanism 140 and the computing mechanism 150 may also be built in the embroidery head 191. The X axis driving unit 183 and the Y axis driving unit 184 for moving the stage 13 and the bobbin thread rotation driving unit 182, are provided in the lower body 192.

The embroidery data editing mechanism 140 acquires the embroidery image (embroidery file) that is the source of the embroidery data and creates embroidery data (initial embroidery data) based on the embroidery image. Further, the embroidery data editing mechanism 140 outputs, as the embroidery data to be output, the created initial embroidery data or correction embroidery data (modified embroidery data) obtained by replacing the initial embroidery data as needed by the control of the computing mechanism 150, to the driving driver 160.

Here, the embroidery image is the image data (embroidery design data) that is the original draft of the embroidery pattern to be formed on the cloth. The embroidery data creating unit 402 of the embroidery data editing mechanism 140 decomposes the embroidery image that is image information into each color, determines the color of the thread to be used and the continuous length of each color on the thread based on the size of the embroidery pattern on the cloth, and creates embroidery data for forming stitches on the cloth using the determined color of thread.

More specifically, embroidery data is "data that combines data of the coordinates to which the needle is to be moved and the operation to be implemented at the coordinates". Specifically, the operation to be implemented at the coordinates are as follows, for example, among other operations.

(1) Insert the needle into the cloth to intertwine with the bobbin thread, return the needle to the front side of the cloth, and then move the needle to the position where the needle is to be inserted next.

(2) End or interrupt the embroidery (including switching to another needle, cutting the thread to move to another position where the embroidery is not continued).

(3) Move to the initialization position (alignment position).

Further, as embroidery data files, formats such as ".dst", ".pes" or the like are commonly known. The initial embroidery data is data that is initially set, and is embroidery data before being edited according to the thread consumption amount.

The computing mechanism 150 calculates the assumed consumption amount of the needle thread on the basis of the initial embroidery data and sets the embroidery condition for correcting any deviation according to need, by referring to the progress of the number of stitches detected by the stitch sensor 15 or the like and the actual consumption amount of the needle thread N detected by the thread consumption amount detection mechanism 6, and outputs the embroidery condition to the embroidery data editing mechanism 140.

The driving driver 160 drives and controls the drive motor 17 on the basis of embroidery data.

The needle up-and-down driving unit 181, referred to as a needle thread take up, drives the vertical movement of the needle 11 through which the needle thread N is passed, by converting the rotational movement of the upper shaft coupled to the drive motor 17 into a vertical movement.

The bobbin thread rotation driving unit 182 rotates the bobbin thread rotation body 12 in conjunction with the vertical movement of the needle 11 by the rotational movement of a lower shaft coupled to the upper shaft via a belt cam crank.

The X axis driving unit 183 and the Y axis driving unit 184 are stage movement driving units (cloth feeding units) that drive the X direction and Y direction movement of the stage 13 on which the cloth C is mounted in conjunction with the vertical movement of the needle 11 and the rotation of the bobbin thread rotation body 12 by the rotation of the lower axis. In this case, as a method of feeding the cloth C, the entire stage 13 may be moved, or the feed teeth provided in holes 130 formed in the stage 13 may be moved.

The needle up-and-down driving unit 181, the bobbin thread rotation driving unit 182, the X axis driving unit 183, and the Y axis driving unit 184 form a driving mechanism 18 driven in conjunction with one driving motor 17. Therefore, the rotation of the drive motor 17 causes the vertical movement of the needle 11, the rotation movement of the bobbin thread rotation body 12, and the XY movement of the cloth C on the stage 13. For example, one up and down movement of the needle 11 is associated with one or an integral number of rotation movements of the bobbin thread rotation body 12.

(Tension of Needle Thread and Bobbin Thread)

Figure 3:
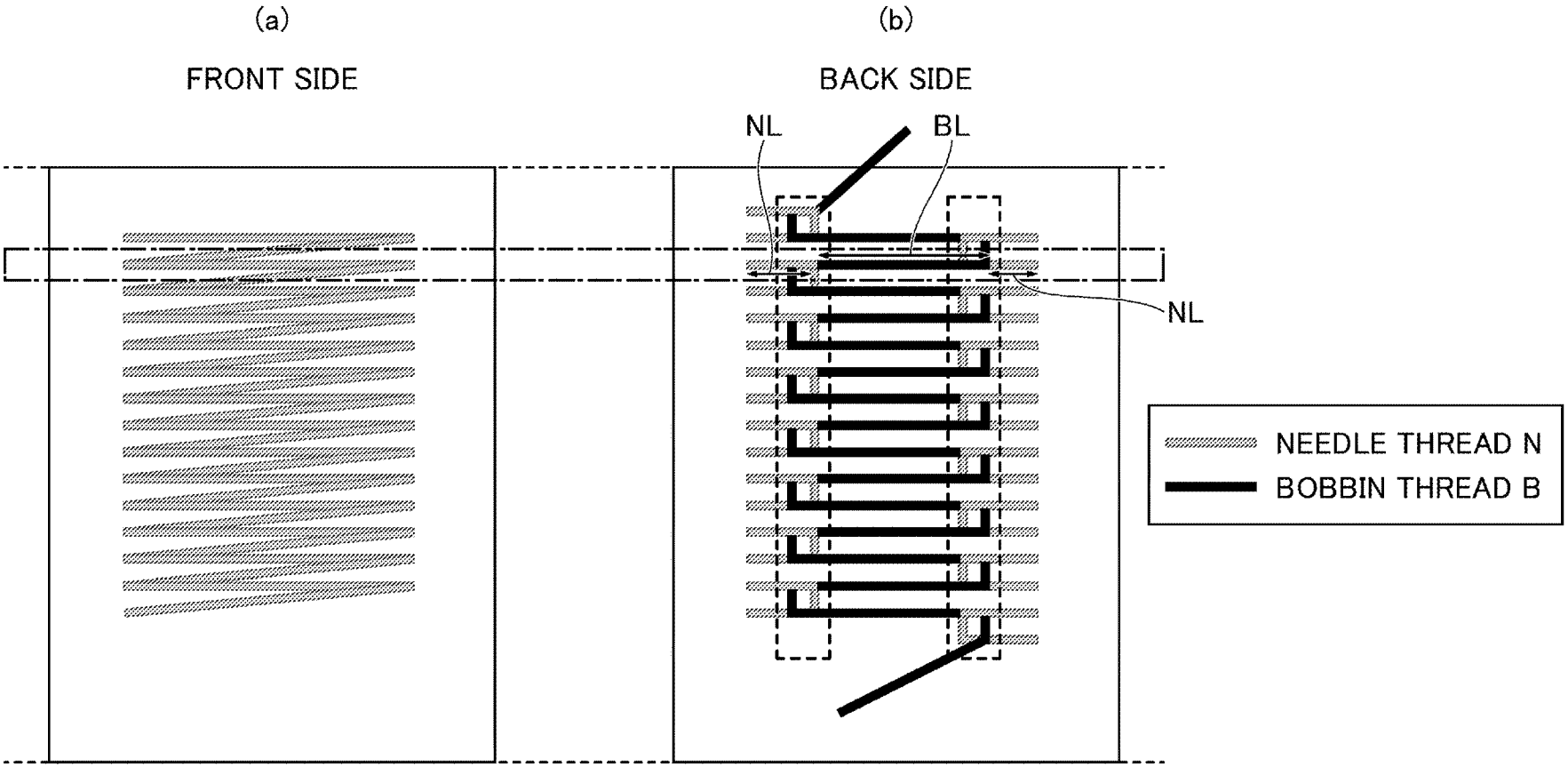
FIG. 3 is a schematic diagram of an example of stitches on the front side and the back side of a needle thread and a bobbin thread with respect to a cloth according to the first embodiment of the present invention.
Figure 4:
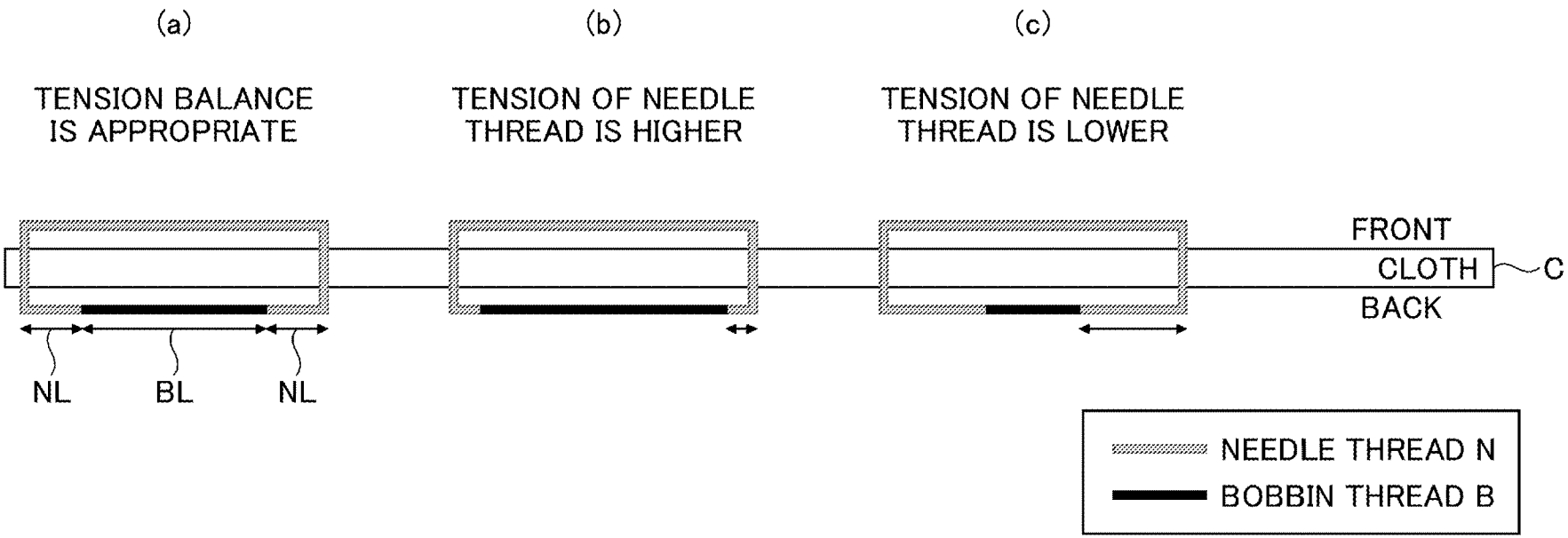
FIG. 4 is a cross-sectional diagram of multiple states of stitches of a needle thread and a bobbin thread with respect to a cloth according to the first embodiment of the present invention.

FIG. 3 is a schematic diagram illustrating an example of the stitches on the front side and the bottom side of the needle thread and the bobbin thread with respect to the cloth. In FIG. 3, (a) is a top view and (b) is a bottom view. FIG. 4 is a diagram illustrating a balance between the needle thread and the bobbin thread at the stitches in the cloth. In FIG. 4, (a) illustrates the case where the tensions of the needle thread and the bobbin thread are properly balanced, (b) illustrates the case where the tension of the needle thread is high, and (c) illustrates the case where the tension of the bobbin thread is high.

In the embroidery apparatus 1, when the needle 11 is lowered and the needle 11 passes through the cloth C, the needle thread N is also drawn into the back side of the cloth C with the needle 11. Thereafter, when the needle 11 is raised and removed from the cloth C and returned to the front side of the cloth C, the needle thread N creates a loop on the back side of the cloth C to remain due to the frictional force with respect to the cloth C. At this time, the hook 122 is caught in the loop-like needle thread N by rotation of the bobbin thread rotation body 12, and the bobbin thread B passes through the loop of the needle thread N. Further, when the needle 11 is raised above the cloth C, a stitch is formed on the cloth C by pulling up the position where the needle thread N and the bobbin thread B intersect, up to the cloth C.

An example of stitches formed in this manner is illustrated in FIG. 3. FIG. 3 is an enlarged view of stitches embroidered by a pattern stitch (satin stitch) so as to fill the surface from the top to the bottom. In FIG. 3(*b*) illustrating the back side, for the purpose of explaining the relationship of the threads so as to be easily understood, the hooking portions of the needle thread N and the bobbin thread B surrounded by dotted lines are loosely illustrated. However, in reality, the hooking portions of the needle thread N and the bobbin thread B are brought into contact with each other and pulled together.

FIG. 4 is a cross-sectional view of the region illustrated with a dashed-dotted line in FIG. 3. If the tension balance between the needle thread and the bobbin thread is appropriate in the cross-section of the stitches illustrated in FIG. 3, the cross-section will appear to be as illustrated in FIG. 4(*a*).

In stitches formed in this manner, when the tension of the needle thread N is high, the needle thread N pulls the bobbin thread B as illustrated in FIG. 4(*b*), so that the amount of the needle thread N that is drawn to the back side of the cloth C is smaller than in the case of the proper balance illustrated in FIG. 4(*a*). That is, a length BL of the bobbin thread becomes long, and a length NL of the needle thread becomes short on the back side. Therefore, if the tension of the needle thread continues to be high, the consumption amount (usage amount) of the needle thread becomes is smaller than the predicted amount, and the consumption speed of the needle thread N becomes slower.

On the other hand, when the tension of the needle thread is low, the needle thread N is drawn to the bobbin thread B as illustrated in FIG. 4(*c*), so that the amount of the needle thread N that is drawn to the back side of the cloth C is increased compared to the case of the proper balance illustrated in FIG. 4(*a*). That is, the length BL of the bobbin thread becomes short, and the length NL of the needle thread becomes long on the back side. Therefore, if the tension of the needle thread continues to be low, the consumption amount of the needle thread N becomes larger than the predicted amount, and the consumption speed of the needle thread N becomes faster.

In this way, the consumption speed of the needle thread N depends on the amount of the thread that is drawn to the back side of the cloth C. When embroidery is continued in a state where the amount of thread drawn to the back side differs from the predicted amount as illustrated in FIG. 4(*b*) and FIG. 4(*c*), there will be a large difference between the predicted amount of the needle thread consumption amount and the cumulative amount of thread consumed. Because the thread consumption amount is set in accordance with the color of the needle thread, or because the dyeing of the needle thread is performed with respect to a predicted position of the thread consumption amount, if the colored thread is not correctly positioned, the color position in the embroidery will be deviated and the embroidery pattern on the cloth will be impaired.

Accordingly, in an embodiment of the present invention, the consumption amount of the needle thread is detected, and the embroidery operation is adjusted so as to reduce the difference between the consumption amount and the predicted consumption amount, to adjust the consumption amount of the thread.

As a method of detecting the difference in the consumption amount of the needle thread N, the actual needle thread consumption amount based on the actually detected detection information (detection information of the thread consumption amount detection mechanism 6), information about how far the embroidery has progressed (coordinate position information calculated from the stitch sensor 15), and the assumed thread consumption amount predicted from the initial embroidery data, are compared. In an embodiment of the present invention, the actual thread consumption amount is detected and calculated just before the point of thread color change that particularly needs to be detected, and by comparing the actual consumption amount with the assumed consumption amount, the deviation amount in the consumption amount of the needle thread can be calculated, and the embroidery can be adjusted before the thread changing position.

(Mechanism of Needle Thread Consumption Amount Detection)

Figure 5A:
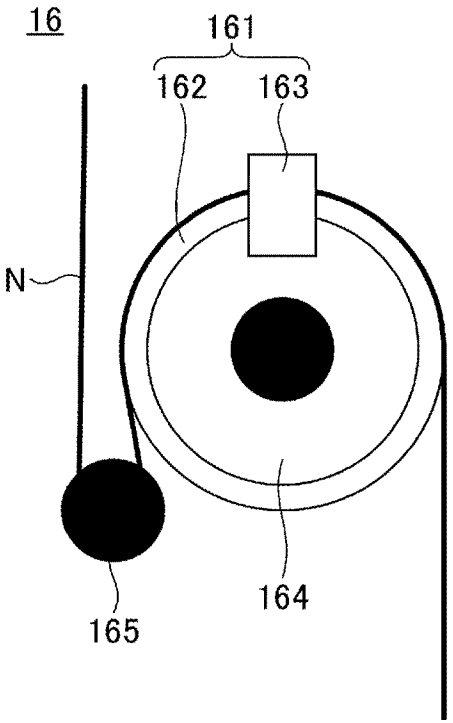
FIGS. 5A to 5C are diagrams illustrating a sensor used for detecting a consumption amount of a needle thread in the embroidery apparatus according to the first embodiment of the present invention.
Figure 5B:
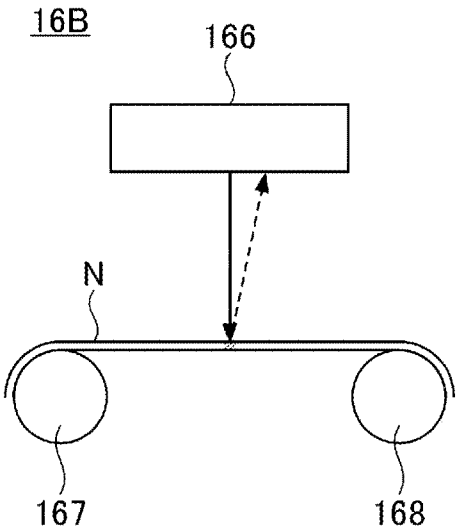
Figure 5C:
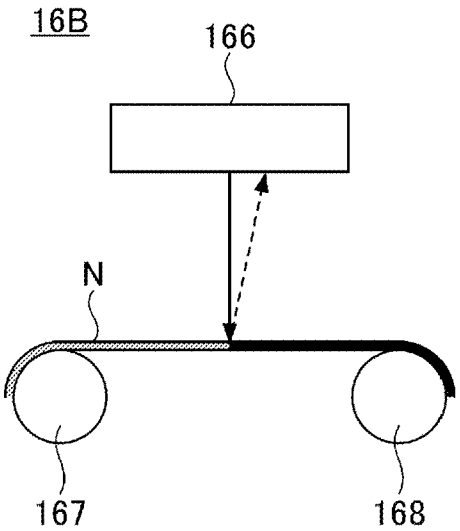

FIGS. 5A to 5C are an explanatory diagrams illustrating a sensor used for detecting the consumption amount of the needle thread N in the embroidery apparatus 1 according to an embodiment of the present invention. FIG. 5A is a diagram illustrating the needle thread detecting unit 16 including a rotary encoder (the sensor 161), and FIGS. 5B and 5C are diagrams illustrating a needle thread detecting unit 16B including an optical sensor 166. The rotary encoder (the sensor 161) and the optical sensor 166 are referred to as sensors.

In the detecting method illustrated in FIG. 5A, the sensor 161 is a sensor provided in a conveying roller 164 which rotates with the conveyance of the needle thread, and does not correlate the detection of the needle thread N with the color. FIG. 5A illustrates an example in which a conveying roller 165 is provided just before the needle thread N so that the needle thread N is appropriately wound on the conveying roller 164.

For example, the conveying roller 164 is provided with the rotary encoder (the sensor 161) as an accompanying sensor. The rotary encoder (the sensor 161) includes an encoder wheel 162 that rotates with the conveying roller 164 and an encoder sensor 163 that reads slits in the encoder wheel 162.

In this configuration, when the needle thread N is conveyed, the conveying roller 164 guiding the needle thread N rotates, and the encoder wheel 162 of the rotary encoder (the sensor 161) rotates. The encoder pulse proportional to the linear speed of the needle thread N is generated and output from the encoder sensor 163.

A needle thread consumption amount calculating unit 504 (see FIG. 6) provided on the computing mechanism 150 side calculates the cumulative conveyance amount of the needle thread N from the rotation amount of the encoder pulse generated with the rotation of the conveying roller 164, to calculate the thread consumption amount. In this configuration, the needle thread detecting unit 16 and the needle thread consumption amount calculating unit 504 form the thread consumption amount detection mechanism 6.

In the configuration illustrated in FIG. 5A, the color change is not used to detect the consumption amount of the needle thread N, and, therefore, when the detection is requested at a position where the same color continues, for example, a predetermined number of stitches before the assumed color change position reaches the tip of the needle 11, it is possible to detect the consumption amount of the needle thread N at this timing, even in the absence of a special color marker or a boundary. The control using this sensor 161 will be described in detail with the flow of FIGS. 7 and 16 as the first control example and the second control example.

The optical sensor 166 illustrated in FIGS. 5B and 5C detects the color of the needle thread N tensioned between the conveying rollers 167 and 168, thereby reading the detection timing of a particular color on the needle thread N.

In the detection method illustrated in FIG. 5(*b*), a portion having a color different from that of other portions, serving as a marker, is provided on the needle thread N. Then, the optical sensor 166 detects the timing when the marker is read at a position facing the sensor (the sensor position), as the detection timing of the needle thread N.

The marker is provided at a predetermined position on the thread in advance, so that if the timing of detecting the position of the marker is known, it is possible to identify the conveyance distance up to now, that is, the actual thread consumption amount. Now, if the distance from the detection position of the optical sensor 166 to the tip of the needle 11 and the embroidery position (the position where the embroidery is performed) at the time of marker detection are identified from the detection result of the stitch sensor 15 or the driving driver 160, it is possible to calculate the position in the actual embroidery to which the marker position will come, from the detection timing. Once the timing of the marker detection is known, the assumed consumption amount to the assumed marker position at that time can be calculated.

In the detection method illustrated in FIG. 5C, the needle thread is continuously provided with different colors in the conveying direction. Then, the optical sensor 166 detects the timing when a boundary between different colors (color change position) is read at a position facing the sensor, as the detection timing of the needle thread N.

The color change position is provided at a predetermined position on the thread in advance, and, therefore, if the detection timing of the color change position is known, the conveyance distance up to now, that is, the actual thread consumption amount, is known. Here, if the distance from the detection position of the optical sensor 166 to the tip of the needle 11 and the embroidery position at the time of color change detection are known from the stitch sensor 15 or the driving driver 160, it is possible to calculate the position in the actual embroidery to which the color change position will come. Then, if the detection timing of the color change position is known, the assumed consumption amount up to the assumed color change position at that time can be calculated.

In the configuration using the sensor 166 illustrated in FIGS. 5B and 5C, a needle thread detecting unit 16B, the needle thread consumption amount calculating unit 504, and the color change position storage unit 513 (see FIG. 17) configure a thread consumption amount detection mechanism 6B. The control using the sensor 166 illustrated in FIGS. 5B and 5C is described in detail with the flow of FIG. 18 and the explanatory view of FIG. 19 as a third control example.

Thus, the sensors 161 and 166 of either configuration can obtain the actual consumption amount of the needle thread N in the embroidery apparatus 1 according to an embodiment of the present invention.

(Functional Block of First Control Example)

Figure 6:
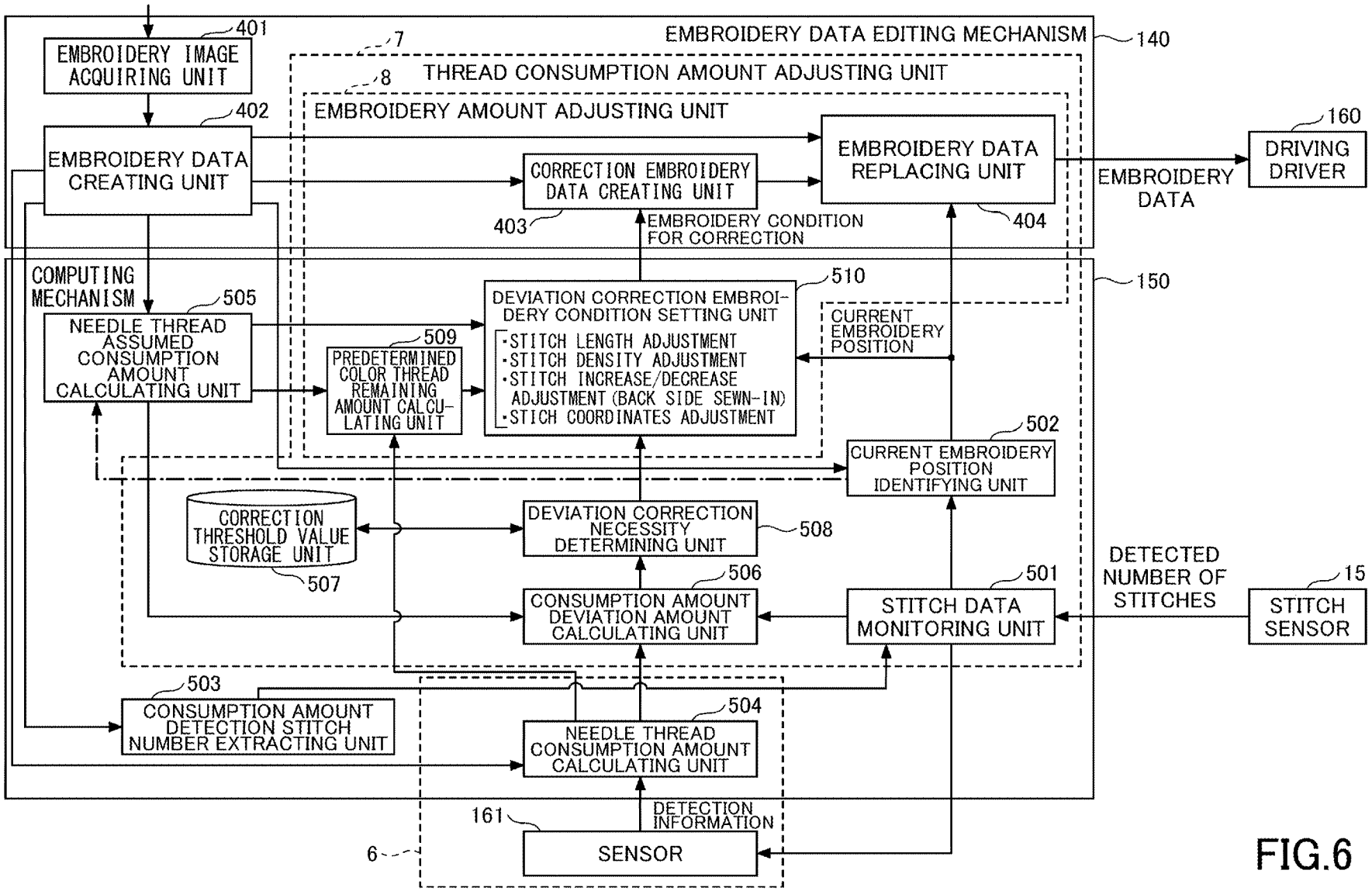
FIG. 6 is a functional block diagram of an embroidery data editing mechanism and a computing mechanism of a first control example according to the first embodiment of the present invention.

FIG. 6 is a functional block diagram of the embroidery data editing mechanism 140 and the computing mechanism 150 of the embroidery apparatus 1 according to the first control example according to the first embodiment. Both the embroidery data editing mechanism 140 and the computing mechanism 150 are control apparatuses implemented by information processing apparatuses such as a Central Processing Unit (CPU), an Application Specific Integrated Circuit (ASIC), a Field Programmable Gate Array (FPGA), and the like.

The embroidery data editing mechanism 140 includes an embroidery image acquiring unit 401, an embroidery data creating unit 402, a correction embroidery data creating unit 403, and an embroidery data replacing unit 404, in an executable manner.

The embroidery image acquiring unit 401 acquires an embroidery image (embroidery file) that is image data.

The embroidery data creating unit 402 creates embroidery data (initial embroidery data) based on the acquired embroidery image. The embroidery data is data in which data of the coordinates to which the needle 11 is to be moved as described above and the content to be performed at the corresponding position, are paired. FIG. 6 illustrates an example in which the initial embroidery data is created based on the embroidery image in the embroidery data editing mechanism 140, but the initial embroidery data may be input directly from an external source.

The correction embroidery data creating unit 403 creates the correction embroidery data to which the embroidery condition for correction is applied when necessary, with respect to the initial embroidery data created by the embroidery data creating unit 402.

In the embroidery data replacing unit 404, the initial embroidery data and the correction embroidery data are input, and when correction is not necessary, the initial embroidery data is sent to the driving driver 160 as the embroidery data to be output, and when correction is necessary, the correction embroidery data is sent to the driving driver 160 as the embroidery data to be output.

The computing mechanism 150 includes a stitch data monitoring unit 501, a current embroidery position identifying unit 502, a consumption amount detection stitch number extracting unit 503, a needle thread consumption amount calculating unit 504, a needle thread assumed consumption amount calculating unit 505, a consumption amount deviation amount calculating unit 506, a correction threshold value storage unit 507, a deviation correction necessity determining unit 508, a predetermined color thread remaining amount calculating unit 509, and a deviation correction embroidery condition setting unit 510, in an executable manner.

The stitch data monitoring unit 501 acquires, in real time, stitch data (a stitch number, i.e., the number of stitches) that is data, which represents how many stitches have progressed, output from the stitch sensor 15, that is, which stitch is currently being sewn.

The current embroidery position identifying unit 502 calculates the current embroidery position data, representing the extent to which embroidery has progressed in the initial embroidery data, from the initial embroidery data and the stitch data.

Based on the initial embroidery data, the consumption amount detection stitch number extracting unit 503 extracts and stores the thread consumption amount up to the time point t1 that is several tens of stitches before the time point t2 at the position of the needle thread of the marker or the boundary of the color, on the continuous thread N including a color change (in which the color is changed), and the number of stitches (stitch number) corresponding to the consumption amount up to the position on the needle thread.

The stitch data monitoring unit 501 transmits a detection instruction to the sensor 161 at a timing t1 at which the stitch number detected by the stitch sensor 15 reaches the consumption amount detection stitch number extracted by the consumption amount detection stitch number extracting unit 503. The sensor 161, which is a rotary encoder, detects the cumulative conveyance amount at the time point t1.

The needle thread consumption amount calculating unit 504 (thread consumption amount calculating unit) calculates the actual consumption amount of the needle thread N based on the stitch number and the cumulative conveyance amount detected by the sensor 161. Accordingly, the needle thread consumption amount calculating unit 504 calculates the actual thread consumption amount at the time point t1 (current time point) that is several tens of stitches before the time point t2 that is the assumed time point when the color is changed.

The needle thread assumed consumption amount calculating unit 505 (thread assumed consumption amount calculating unit) predicts the assumed consumption amount of the needle thread each time the stitching progresses (assumed consumption amount) based on the initial embroidery data and the current stitch data (data representing how many stitches have progressed). For example, the assumed consumption amount of the needle thread N is increased when the length between the stitches is long and the embroidery involving movements of long distances is continued on the cloth C on the stage 13, and the assumed consumption amount of the needle thread N is decreased when the length between the stitches is short and the embroidery involving movements of short distances is continued on the cloth C on the stage 13.

More specifically, the needle thread assumed consumption amount calculating unit 505 calculates the assumed consumption amount of the thread at the time point t1. Further, the needle thread assumed consumption amount calculating unit 505 calculates the cumulative assumed consumption amount of the thread of a predetermined color up to the time point t2 that is the assumed time point when the color is changed, in the dye region of a predetermined color before the color changes on the thread.

The consumption amount deviation amount calculating unit 506 acquires the current embroidery position data from the current embroidery position identifying unit 502 and calculates the deviation amount of the actual needle thread consumption amount (the actual thread consumption amount detected and calculated at the time point t1) calculated by the needle thread consumption amount calculating unit 504, from the assumed consumption amount at the time point t1 predicted by the needle thread assumed consumption amount calculating unit 505.

The correction threshold value storage unit 507 stores a threshold value (a predetermined value) of the deviation amount of the needle thread consumption amount that requires correction of the initial embroidery data.

The deviation correction necessity determining unit 508 compares the deviation amount calculated by the consumption amount deviation amount calculating unit 506 with the threshold value of the deviation amount stored in the correction threshold value storage unit 507 and determines whether correction of the initial embroidery data is necessary.

The predetermined color thread remaining amount calculating unit 509 calculates the remaining amount of thread (thread remaining amount) by which a particular color continues from the time point t1 to the position where the color is changed on the needle thread, based on the actual thread consumption amount at the time point t1 calculated by the needle thread consumption amount calculating unit 504.

When it is determined that correction of the initial embroidery data is necessary by the deviation correction necessity determining unit 508, the deviation correction embroidery condition setting unit 510 sets various embroidery conditions for correction of the initial embroidery data. The embroidery conditions for correction are for adjusting the method of sewing from the initial embroidery data, for example, stitch density adjustment (FIGS. 8 and 9), stitch length adjustment (FIGS. 8 and 10), stitch increase/decrease (backside sewing in), stitch coordinate adjustment of the base sewing (FIGS. 13 and 14), and the like.

At this time, the deviation correction embroidery condition setting unit 510 sets the embroidery condition so that the amount of the remaining thread is consumed appropriately in the period T12 from the time point t1 to the time point t2' which is the actual color change position, based on the difference in the consumption amount so that the actual cumulative consumption amount of the thread of the predetermined color at the time point t2' when the color change is actually made is the same as the cumulative assumed consumption amount of the thread of the predetermined color at the time point t2 when the assumed color change is made, in a dye region of the predetermined color before the color on the thread changes. Details of each embroidery condition are described with reference to FIGS. 8 to 14.

When correction is required for the initial embroidery data, the correction embroidery data creating unit 403 applies the correction embroidery condition set by the deviation correction embroidery condition setting unit 510 with respect to a portion of the initial embroidery data to create the correction embroidery data.

The embroidery data replacing unit 404, upon referring to the current embroidery position identified by the current embroidery position identifying unit 502, transmits the correction embroidery data after replacement to the driving driver 160 as embroidery data to be output, at a period T12 from the time point t1 to the time point t2', which is the actual color change position. The embroidery data replacing unit 404 transmits the initial embroidery data as embroidery data to be output to the driving driver 160 in periods other than the above period.

According to the present embodiment, in the embroidery apparatus 1, the consumption amount deviation amount calculating unit 506, the correction threshold value storage unit 507, the deviation correction necessity determining unit 508, the predetermined color thread remaining amount calculating unit 509, the deviation correction embroidery condition setting unit 510, the correction embroidery data creating unit 403, and the embroidery data replacing unit 404 function as a thread consumption amount adjusting unit 7. In the thread consumption amount adjusting unit 7, the predetermined color thread remaining amount calculating unit 509, the deviation correction embroidery condition setting unit 510, the correction embroidery data creating unit 403, and the embroidery data replacing unit 404 function as an embroidery amount adjusting unit 8.

(Flowchart of First Control Example)

Figure 7:
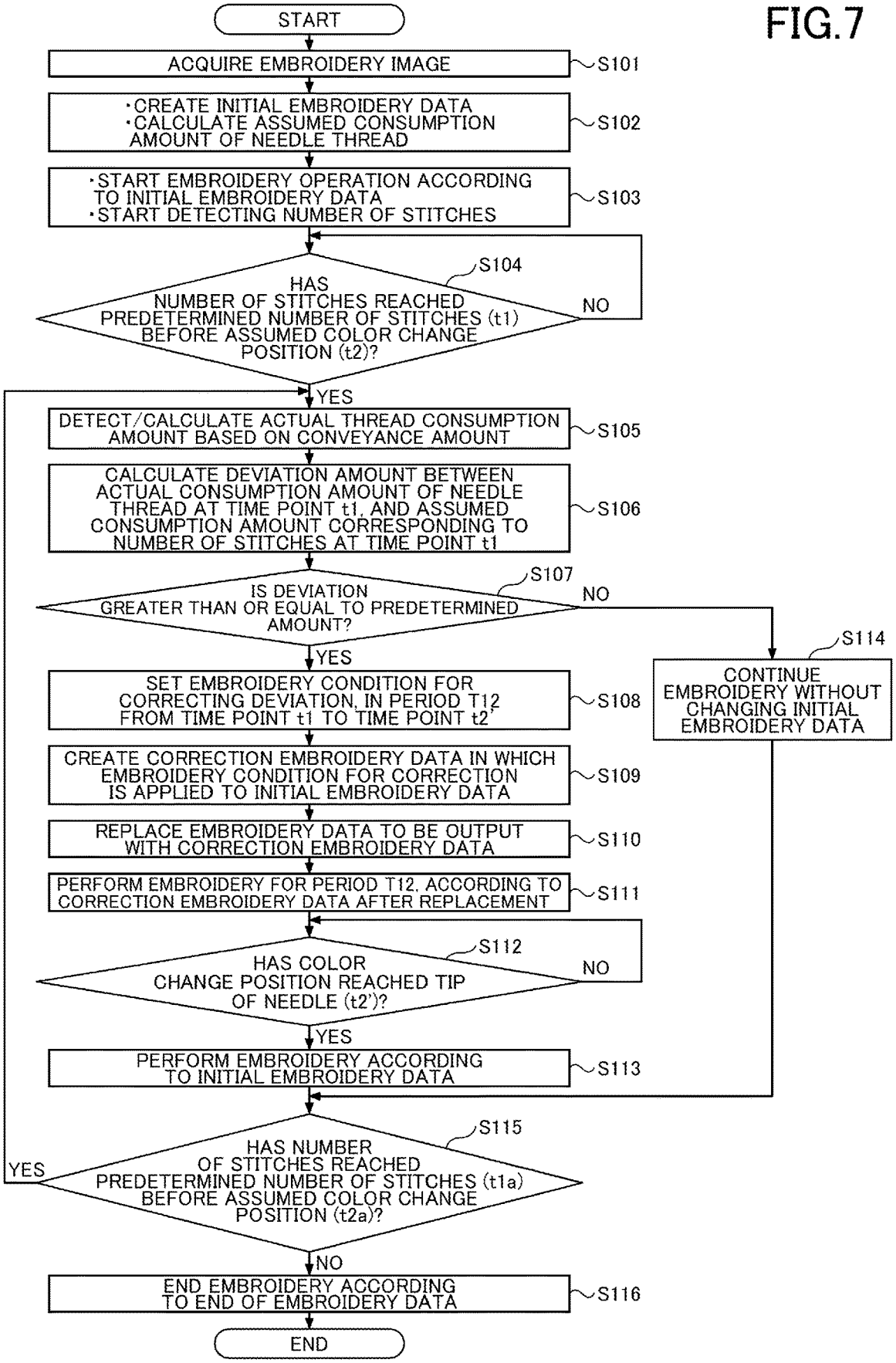
FIG. 7 is a flowchart of embroidery according to the first control example according to the first embodiment of the present invention.

FIG. 7 is a flowchart of embroidery according to a first control example according the a first embodiment of the present invention. This flow is applied when the rotary encoder (the sensor 161) illustrated in FIG. 5A is used as a sensor of the thread consumption amount detection mechanism.

In step S101, the embroidery apparatus 1 acquires an embroidery image.

In step S102, the embroidery data editing mechanism 140 creates the initial embroidery data, and the computing mechanism 150 calculates the assumed consumption amount of the needle thread per stitch.

In step S103, the embroidery operation in accordance with the initial embroidery data is started at the embroidery apparatus 1, and the detection (count) of the number of stitches (stitch number) of the needle 11 is started at the stitch sensor 15.

In step S104, when the counted stitch number reaches the consumption amount detection stitch number that is a predetermined stitch number before the color change position, in step S105, the thread consumption amount detection mechanism 6 detects and calculates the actual consumption amount of the needle thread N. The predetermined stitch number before the color change position refers to, for example, ten to several tens of stitches before the color change position.

In step S106, the computing mechanism 150 compares the actual consumption amount of the needle thread N detected and calculated in step S105 with the assumed consumption amount of the needle thread corresponding to the stitch number reached in step S104 in the assumed consumption amount calculated in step S102, and calculates the deviation amount of the consumption amount. That is, in step S106, the actual thread consumption amount at the time point t1 (current time point) that is several tens of stitches before the assumed time point t2 (future) at which the color changes, is compared with the assumed thread consumption amount at the time point t1 (current time point).

In step S107, when the deviation amount calculated in S106 is greater than or equal to a predetermined amount (YES), the process proceeds to step S108, and when the deviation amount is less than a predetermined amount (NO in step S107), the process proceeds to step S114 and continues embroidery while with the initial embroidery data unchanged.

In step S108, the embroidery condition is set in order to correct the deviation amount, in the computing mechanism 150.

Therefore, as the embroidery condition, the consumption amount during the (future) period T12 from the time point t1 (the current time) to the future time point t2' is adjusted, such that the actual thread consumption amount at the future time point t2' when the color on the thread changes becomes the same as the assumed consumption amount at the future time point t2'. The future time point t2' used for adjustment is the time point at which the stitch reaches the position where the color changes on the actual thread, and is a time point that changes depending on the thread remaining amount and the embroidery adjustment method. For example, the embroidery condition is set such that if the actual consumption amount at the time point t1 is less than the assumed consumption amount, the consumption amount in the period T12 is increased, and if the actual consumption amount at the time point t1 is greater than the assumed consumption amount, the consumption amount in the period T12 is reduced.

In step S109, in the embroidery data editing mechanism 140, the corrected embroidery data (correction embroidery data) is created by applying the embroidery correction condition on the initial embroidery data.

In step S110, in the embroidery data editing mechanism 140, the embroidery data to be output is set by replacing the initial embroidery data with the correction embroidery data, and the embroidery data is output to the driving driver 160.

In step S111, the driving driver 160 drives and controls the drive motor 17 to perform embroidery, based on the embroidery data after replacement (the correction embroidery data), during the period T12 until the tip of the needle 11 reaches the time point t2' of the actual color change position in step S112.

In step S112, when the timing at which the actual color change position on the thread reaches the tip of the needle 11 (time point t2') is reached, the embroidery is performed upon returning to the initial embroidery data in step S113.

Then, in step S115, when the stitch number reaches a consumption amount detection stitch number that is a predetermined number of stitches (t1*a*) before the time point (t2*a*) of the next color change position, the calculation of the consumption amount and adjustment of the embroidery data are performed in steps S105 to S114, and embroidery is executed in line with the embroidery data until the entire embroidery data is completed in step S116.

When the entire embroidery data is completed in step S116, the embroidery in the embroidery apparatus 1 is ended.

As described above, in the present control example, according to the difference between the assumed consumption amount of the needle thread associated with the number of stitches calculated from the initial embroidery data and the actual consumption amount of the needle thread detected and calculated by counting the stitch number, the embroidery condition is set for the initial embroidery data, the correction embroidery data is created, and embroidery is performed according to the correction embroidery data, thereby adjusting the consumption amount of the needle thread N.

For example, in the embroidery apparatus 1, as described above, when the drive motor 17, which is a single drive source, causes the bobbin thread bobbin 121 to rotate in accordance with the intervals of the vertical motion of the needle 11, the needle thread and the bobbin thread are adjusted so that an appropriate balance is maintained at the stitch. Here, at a timing when the amount of the needle thread used in the embroidery apparatus 1 changes significantly, such as at a time point when the length of the stitch changes significantly, the tension of the needle thread N changes suddenly. However, due to the inertial force of the rotation of the needle thread reel 14, the tension of the needle thread N immediately after being unwound cannot change abruptly, but the tension of the bobbin thread changes according to the rotation of the bobbin thread bobbin 121 at the timing when the amount of the needle thread used changes significantly. Therefore, an imbalance between the needle thread and the bobbin thread at the stitch occurs due to the difference in tension between the needle thread and the bobbin thread. Accordingly, the actual consumption amount of the needle thread temporarily increases or decreases from the assumed value.

Accordingly, in an embodiment of in the present invention, the consumption amount of the thread used for embroidery is adjusted by synthesizing the embroidery data so as to adjust the sewing method of the needle thread at another portion. By implementing such control, in the embroidery apparatus 1, when a continuous needle thread including a color change is used, the positional deviation of color caused by the deviation of the consumption amount in the embroidery apparatus 1 can be eliminated, even when the amount of the needle thread used differs from the assumed amount due to the difference in tension between the needle thread and the bobbin thread and the like.

(Examples of Embroidery Condition for Correction)

An embroidery condition for correction will be described with reference to FIGS. 8 to 14 below.

Figure 8:
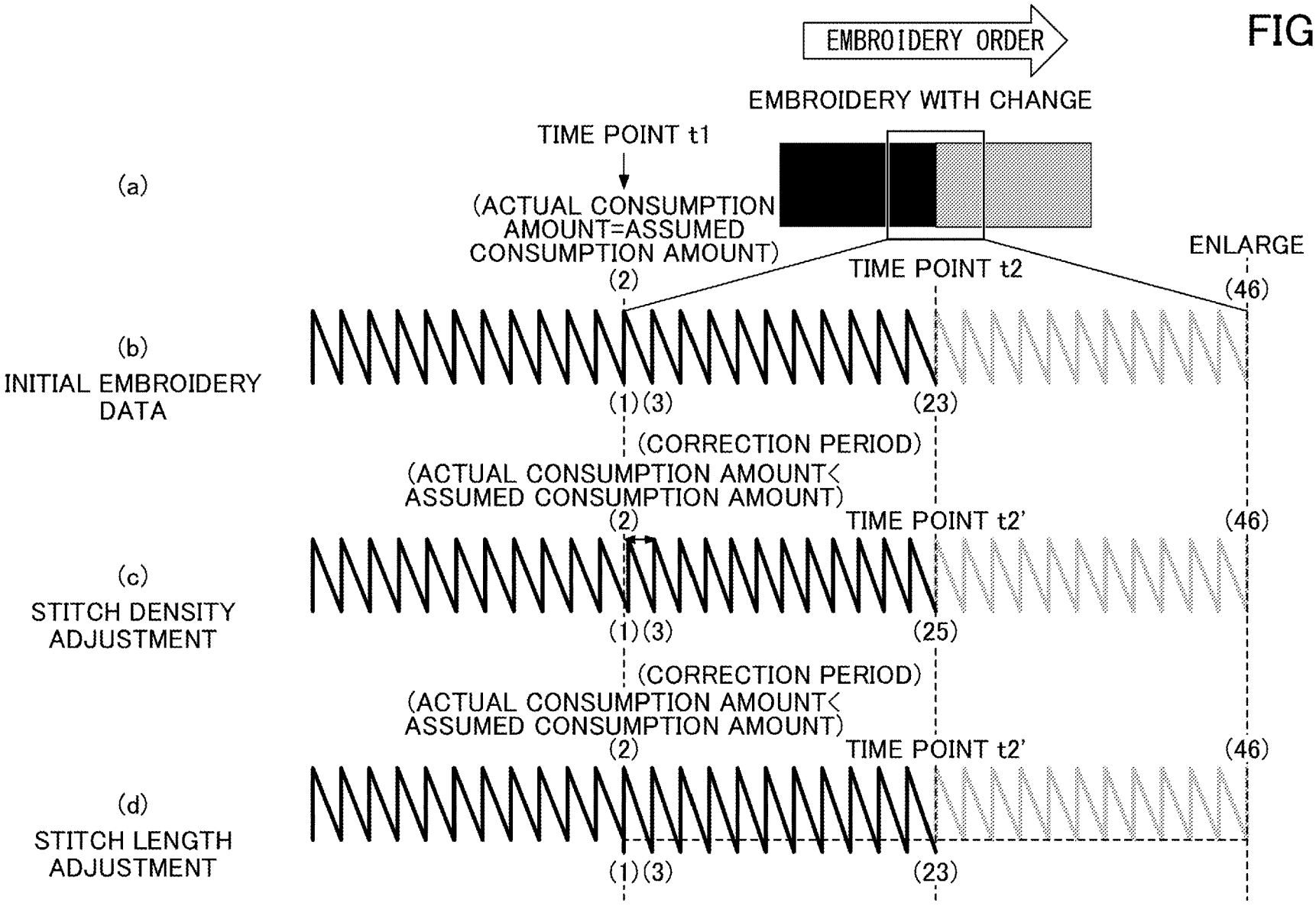
FIG. 8 illustrates an example of changing the stitch density and the stitch length as correction embroidery conditions according to the first embodiment of the present invention.

FIG. 8 illustrates an example of changing the stitch density and the stitch length as a correction embroidery condition (embroidery condition for correction). FIG. 8(*a*) is a diagram illustrating an example of embroidery in which the color is switched (changed), and FIGS. 8(*b*) to 8(*d*) are enlarged views of stitches embroidered by a pattern stitch (satin stitch) so as to fill the surface of the embroidery region of FIG. 8(*a*). FIG. 8(*b*) is an enlarged view of stitches that serve as a reference, in which embroidery is performed according to the initial embroidery data with no deviation in the consumption amount. FIG. 8(*c*) is an enlarged view of the embroidered stitches formed by adjusting the stitch density of the initial embroidery data. FIG. 8(*d*) is an enlarged view of embroidered stitches formed by adjusting the width (stitch length) of the stitches of the initial embroidery data.

FIG. 9 is a table illustrating a simplified correction example when the stitch density is changed as the correction embroidery condition. FIG. 10 is a table illustrating a simplified correction example when the stitch length is changed as the correction embroidery condition. In the tables in FIGS. 9 and 10, among the lines arranged horizontally, the initial embroidery data is illustrated on the first line L1, the needle thread consumption amount state is illustrated on the second line L2, the adjusted stitch width (stitch length) is illustrated on the third line L3, the adjusted stitch interval is illustrated on the fourth line L4, the state that occurs without adjustment is illustrated on in the fifth line L5, and the state of the adjusted stitch is illustrated on the sixth line L6. With respect to the second line and onwards, among the columns arranged vertically, the first column C1 illustrates the case where consumption amount is small, the second column C2 illustrates the case where consumption amount is not required to be corrected, and the third column C3 illustrates the case where consumption amount is large.

Now, the color change position (the color change position) in a continuous needle thread including a color change when the embroidery progresses from the left side in FIG. 8, is considered. Considering the embroidery as illustrated in FIG. 8(*a*), the enlarged view of the stitches that serve as a reference when embroidery is performed according to the initial embroidery data with no deviation in consumption amount, is as illustrated in FIG. 8(*b*). Examples of simplified implementations from the time point t1 and onwards illustrated in FIG. 8(*b*), are the initial embroidery data illustrated on line L1 in the tables of FIG. 9 and FIG. 10.

Here, when the actual consumption amount of the detected and calculated needle thread is different from the predicted amount, and the actual needle thread consumption amount is smaller than the assumed consumption amount, unless adjustment is performed, the needle thread becomes excessive, and the color change position moves to the right, as illustrated in L5C1 in FIGS. 9 and 10.

On the other hand, when the actual needle thread consumption amount is greater than the assumed consumption amount, unless adjustment is performed, the needle thread becomes insufficient, and as illustrated in L5C3 in FIGS. 9 and 10, the color change position moves to the left.

(Correction Example 1)

In order to prevent such a situation, for example, in the examples illustrated in FIGS. 8(*c*) and 9 as one correction example, the consumption amount of the needle thread is adjusted by adjusting the density of sewing the thread up to the color change position. This adjustment becomes executable when the embroidery stitch density becomes greater than or equal to a value specified by the user.

In the example of FIG. 8, in the embroidery performed in accordance with the initial embroidery data of FIG. 8(*b*), the black region is filled with 23 stitches, but in the embroidery after adjustment of FIG. 8(*c*) where the actual needle thread consumption amount is greater than assumed consumption amount, the black region is filled with 25 stitches.

In the example of FIG. 9, in the embroidery performed in accordance with the initial embroidery data of L1, and in the embroidery in which the deviation amount between the actual amount and the assumed amount is within a predetermined amount illustrated in C2, the black region is filled with 11 stitches at a stitch interval of 0.3 mm between t1 and t2 and between t1 and t2'.

If the actual needle thread consumption amount is less than the assumed consumption amount in FIG. 9, in the embroidery after adjustment illustrated in C1L6, the black region between t1 and t2' is filled with 15 stitches at a stitch interval of 0.2 mm.

As described above, when the actual amount of thread used is less than assumed at a time point t1 several tens of stitches before the assumed color changing time point t2 due to the tension difference between the needle thread and the bobbin thread, the remaining amount of thread up to the color change position is large. Therefore, the amount of thread used can be increased by increasing the density of embroidery during the correction period (the period from t1 to t2') until the actual thread color change position is reached.

Accordingly, in the black dye region of the thread (the region before the color change), the actual cumulative consumption amount of the thread at the future time point t2' at which the color change actually occurs is the same as the cumulative assumed consumption amount of the thread at the future time point t2 that is the assumed color change position. Thus, the color change position of the actual continuous thread can be aligned with the color change position in the embroidery image.

Note that the table in FIG. 9 is illustrated in a simplified manner, and, therefore, there is an inconsistency in the drawing with respect to the remaining length of the black thread in L5 and L6. However, in the actual control, the length of the (black) thread before the color change in t1 to t2 (corresponding to the cumulative assumed consumption amount of the thread at the future time point t2) in a state that occurs without the adjustment illustrated in L5 is controlled so as to be equal to the length of the (black) thread before the color change in t1 to t2' and beyond in a state after the adjustment illustrated in L6 (the cumulative consumption amount of the actual thread at the future time point t2').

On the other hand, when the actual needle thread consumption amount is greater than the assumed consumption amount in FIG. 9, in the embroidery after adjustment illustrated in C3L6, the black region between t1 and t2' is filled with 7 stitches at a stitch interval of 0.4 mm.

As described above, when the actual amount of thread used becomes larger than assumed at a time point t1 several tens of stitches before the assumed color changing time point t2 due to a tension difference between the needle thread and the bobbin thread, the remaining amount of thread up to the color change position is small. Therefore, the amount of thread used can be reduced by reducing the density of embroidery during the correction period (period from t1 to t2') until the actual thread color change position is reached.

Accordingly, in the black dye region of the thread (the region before the color change), the actual cumulative consumption amount of the thread at the future time point t2' at which the color change actually occurs becomes the same as the cumulative assumed consumption amount of the thread at the future time point t2 that is the assumed color change position. This allows the color change position of the actual continuous thread to be aligned with the color change position in the embroidery image.

Here, when the actual amount of thread used is smaller than the assumed amount, such as in L6C1 in FIGS. 8(*c*) and 9, in the correction for adjusting the stitch density, the actual color change time point t2' will be reached later than the assumed color change time point t2. On the other hand, when the actual amount of thread used is larger than the assumed amount, such as in L6C3 of FIG. 9, the actual color change time point t2' will be reached earlier than the assumed color change time point t2.

This control operation detects the difference between the thread consumption amount assumed from the data (stitch data) representing which stitch is being sewn and from the initial embroidery data, and the actual consumption amount, at the time point t1 that is several tens of stitches before the future time point t2, which is the assumed color change position. On the basis of the difference, when the difference is greater than or equal to a threshold value, the embroidery data to be output is replaced by the correction embroidery data in which the stitch density of the embroidery is changed by adjusting the stitch interval as illustrated in L4C1 and L4C3 in FIGS. 8(*c*) and 9 in the period (correction period) T12 from the detection time point t1 to the future time point t2', which is the actual color change position.

As in the first embodiment, when control is implemented inside the embroidery apparatus 1, the data of the stitch number representing which stitch is being sewn may be automatically acquired from the drive control timing of the driving driver 160, or the data may be detected from the stitch number detected by the stitch sensor 15.

(Correction Example 2)

As another example of correction, as illustrated in FIGS. 8(*d*) and 10, the consumption amount of the needle thread is adjusted by increasing or decreasing, in units of millimeters so as not to be noticeable in appearance, the width of embroidery (the width of the stitch), that is, the length of the stitch, only in the black portion (the region before the color change). This adjustment is possible when the embroidery stitch length (width of stitch) is greater than or equal to the value specified by the user.

In the example of FIG. 8, the actual needle thread consumption amount is less than the assumed consumption amount, and, therefore, the embroidery after adjustment of FIG. 8(*d*) has a longer stitch length than the stitch length of the embroidery performed in accordance with the initial embroidery data of FIG. 8(*b*). By such an adjustment, the amount of thread used can be increased during the correction period to the actual color change position of the thread.

In the example of FIG. 10, for the embroidery performed in accordance with the initial embroidery data of L1 and for the embroidery when the deviation amount between the actual amount and the assumed amount is within a predetermined amount illustrated in C2, the black region is filled with a stitch length of 10 mm between t1 and t2 and between t1 and t2'.

In FIG. 10, when the actual needle thread consumption amount is less than the assumed consumption amount, in the embroidery after adjustment, the black region between t1 and t2' is filled with a stitch length (stitch width) of 11 mm, as illustrated in C1L6. Such an adjustment can increase the amount of thread used during the correction period.

On the other hand, when the needle thread consumption amount is greater than the assumed consumption amount, in the embroidery after adjustment, the black region between t1 and t2' is filled with a stitch length (stitch width) of 9 mm, as illustrated in C3L6. Such an adjustment can reduce the amount of thread used during the correction period.

This control operation detects the difference between the thread consumption amount assumed from the data (stitch data) representing which stitch is being sewn and from the initial embroidery data, and the actual consumption amount, at the time point t1 that is several tens of stitches before the future time point t2, which is the assumed color change position. On the basis of the difference, when the difference is greater than or equal to the threshold value, the embroidery data to be output is replaced by the correction embroidery data in which the width of embroidery (stitch length) is changed in the period (correction period) T12 from the detection time point t1 to the future time point t2' that is the actual color change position.

In this corrected example, the stitch length is changed, but the number of stitches is not changed, so even if the embroidery is adjusted, the embroidery time required for the correction period is substantially unchanged from before the correction.

Note that the table in FIG. 10 is illustrated in a simplified manner, and, therefore, there is an inconsistency in the drawing with respect to the remaining length of the black thread in L5 and L6. However, in the actual control, the length of the (black) thread before the color change in t1 to t2 (corresponding to the cumulative assumed consumption amount of the thread at the future time point t2) in a state that occurs without the adjustment illustrated in L5 is controlled so as to be equal to the length of the (black) thread before the color change in t1 to t2' and beyond in a state after the adjustment illustrated in L6 (the cumulative consumption amount of the actual thread at the future time point t2').

Thus, by adjusting the stitch length (stitch width) during the correction period, the color change position of the actual continuous thread can be aligned with the color change position in the embroidery image.

Thus, in correction examples 1 and 2, the data of the embroidery condition for correcting the density of the embroidery and the width of the embroidery, is adjusted in real time immediately before the color change, in the period until the color change, and the embroidery data to be output is replaced with the adjusted data, to adjust the consumption amount of the thread used for the embroidery. By such a control operation, in the embroidery apparatus 1, when a continuous thread including a color change is used, even when the amount of the needle thread used is different from the assumed amount, by making a slight adjustment in the period until the color change, the positional deviation of the color caused by the deviation in the consumption amount in the embroidery apparatus 1 can be eliminated, without significantly changing the embroidery region in the embroidery image.

(Correction Example 3)

Figure 11:
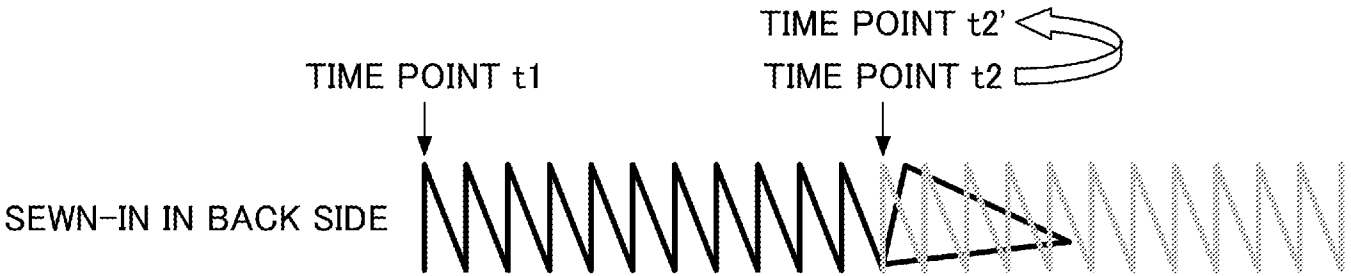
FIG. 11 illustrates an example of sewing into the backside as a correction embroidery condition according to the first embodiment of the present invention.

FIG. 11 illustrates an example of sewing into the backside as a correction embroidery condition. When the detected consumption amount of thread is less than the assumed consumption amount, the initial embroidery data may be replaced so as to sew under the embroidery that is set to be embroidered next. In FIG. 11, the actual consumption amount of the black thread on the left is small so the black thread becomes excessive, and, therefore, immediately before the gray thread begins to be embroidered on the right, the black thread is sewn into the back of the embroidery to consume the black thread. By this adjustment, the amount of thread used can be increased.

In this control operation, embroidery is performed according to the initial embroidery data from the detection time point t1 to the future time point t2, which is the assumed color change position, and from the time point t2 to the future time point t2', which is the actual color change position, the thread is consumed by sewing on the back side. Thus, in the black dye region of the thread, the actual cumulative consumption amount of the thread at the future time point t2' when the color actually changes is the same as the cumulative assumed consumption amount of the thread at the assumed future time point t2. Thus, the actual color change position of the continuous thread can be aligned with the color change position in the embroidery image.

In this control operation, the difference between the assumed thread consumption amount and the actual consumption amount is detected at the time point t1 that is several tens of stitches before the future time point t2, which is the assumed color change position. Based on the detected difference, when the actual consumption amount is small, embroidery is performed with the initial embroidery data unchanged up to the color change position. Then, immediately after the color change position, stitches to be sewn in underneath are added, to consume the needle thread, thereby preventing the color change position from shifting to the right.

This correction performed by sewing into the back side is a correction implemented when the measured consumption amount is less than the initial embroidery data, and is suitable for adjustment when it is inappropriate to change the density or width of the stitches as in FIGS. 8 to 10, such as in the cases where the pattern is small or the stitch width is short or the stitches are rough, and the like, in the set initial embroidery data.

(Correction Example 4)

Figure 12B:
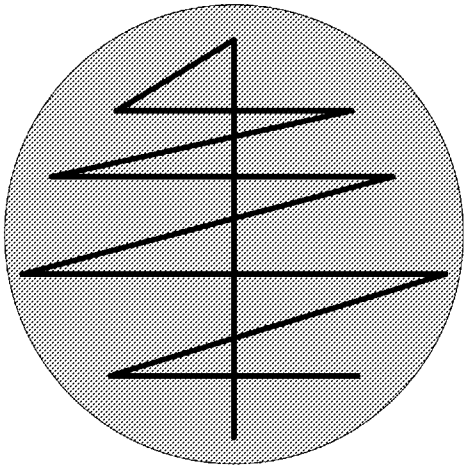
FIGS. 12A and 12B illustrate base sewing in general embroidery.
Figure 12A:
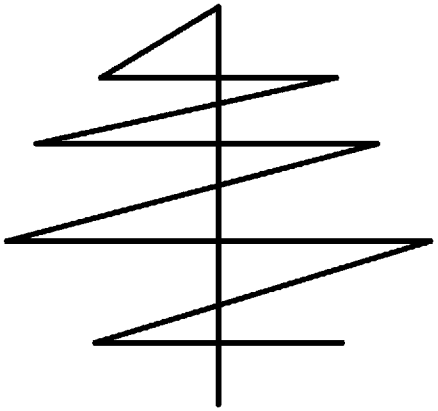

FIGS. 12A and 12B are explanatory diagrams of base sewing in a typical embroidery. FIG. 12A is an explanatory diagram illustrating a state after base sewing, and FIG. 12B is an explanatory diagram illustrating a state where a region is roundly filled with embroidery after the base sewing.

In embroidery, in general, embroidery referred to as base sewing is used for reinforcement, to prevent the cloth from becoming distorted during embroidery. For example, in a circular embroidery such as that illustrated in FIG. 12B, sewing is performed first as indicated by the black lines (base sewing) illustrated in FIG. 12A, thereby preventing distortion from being caused by the subsequent embroidery in the gray area sewn on the black lines.

In an embodiment of the present invention, adjustment of the stitch length of the base sewing can be used to adjust the consumption amount of the needle thread. The stitch length adjustment of the base sewing (thread amount adjustment) is possible when the user specifies the stitches of the base sewing to be used for the adjustment and the range of change.

FIG. 13 is a table illustrating a simplified correction example when the base sewing is adjusted as a correction embroidery condition. In the table in FIG. 13, among the columns arranged horizontally, the initial embroidery data is illustrated on the first line L1, the needle thread consumption state is illustrated on the second line L2, the stitch width (stitch length) after adjustment is illustrated on the third line L3, the stitch interval after adjustment is illustrated on the fourth line L4, the base sewing thread amount is illustrated on the fifth line L5, the state that occurs without adjustment is illustrated on the sixth line L6, and the state of stitches after adjustment is illustrated on the seventh line L7. With respect to the second line and onwards, among the columns arranged vertically, the first column C1 illustrates the case where consumption amount is small, the second column C2 illustrates the case where consumption amount is not required to be corrected, and the third column C3 illustrates the case where consumption amount is large.

In the example of FIG. 13, in the embroidery performed in accordance with the initial embroidery data of L1 and in the embroidery in which the deviation amount between the actual amount and the assumed amount is within a predetermined amount illustrated in C2, the black region is filled at a stitch interval of 0.3 mm with a stitch width of 10 mm between t1 and t2 and between t1 and t2', and the base sewing thread amount is 10 mm.

In the embroidery after adjustment in which the actual needle thread consumption amount is less than the assumed consumption amount, the base sewing thread amount is increased to 12 mm without changing the width or the intervals of the stitches, as illustrated in C1L7. By such an adjustment, the amount of thread used can be increased in the correction period from t1 to t2' up to the actual color change position of the thread.

On the other hand, when the needle thread consumption amount is greater than the assumed consumption amount, in the embroidery after adjustment, the base sewing thread amount is reduced to 8 mm, without changing the width or the intervals of the stitches, as illustrated in C3L7. By such an adjustment, the amount of thread used can be reduced in the correction period from t1 to t2'.

Note that, embroidery of performing base sewing is often performed when a wide area is patterned, but if the base sewing is white, a colored portion and a white portion will alternately appear in a continuous thread. In that case, it is preferable to set the dye region to be slightly longer in advance, so that the base sewing also includes colored portions as in the initial embroidery data, so that when a slight deviation occurs, in particular, when the embroidery thread is consumed longer than originally set and the thread becomes insufficient, adjustments can be made without changing the pattern sewing.

This control operation detects the difference between the thread consumption amount assumed from the data (stitch data) representing which stitch is being sewn and from the initial embroidery data, and the actual consumption amount, at the time point t1 that is several tens of stitches before the future time point t2, which is the assumed color change position. On the basis of the difference, when the difference is greater than or equal to a threshold value, the embroidery data to be output is replaced by the correction embroidery data in which the length of base sewing (amount of thread) is changed in the period (correction period) T12 from the detection time point t1 to the future time point t2', which is the actual color change position.

Note that, in this correction, the amount of the thread of the base sewing is changed, but the number of stitches is not changed, so even when the embroidery is adjusted, there is almost no change in the correction time. Further, the pattern of embroidery is formed on top of the base sewing, and, therefore, even when the amount of thread of the base sewing is adjusted, there is no effect on the appearance of the embroidery. Therefore, base sewing is suitable for the adjustment of embroidery when it is not appropriate to change the density or the width of the stitches as illustrated in FIGS. 8 to 10.

Note that the table in FIG. 13 is illustrated in a simplified manner, and, therefore, there is an inconsistency in the drawing with respect to the remaining length of the thread (base sewing thread+black thread) in L6 and L7. However, in the actual control, the length of the thread (base sewing thread+black thread) before the color change in t1 to t2 (corresponding to the cumulative assumed consumption amount of the thread at the future time point t2) in a state that occurs without the adjustment illustrated in L6 is controlled so as to be equal to the length of the length of the thread (base sewing thread+black thread) before the color change in t1 to t2' and beyond in a state after the adjustment illustrated in L7 (the cumulative consumption amount of the actual thread at the future time point t2').

Thus, by adjusting the amount of thread in the base sewing in the correction period, the actual color change position in the continuous thread can be aligned with the color change position in the embroidery image.

Further, when the deviation amount of the needle thread consumption amount is large and it is not possible to compensate for the deviation amount even by the adjustment by base sewing, particularly when the thread becomes insufficient, the density and length of the pattern sewing may be adjusted as illustrated in FIGS. 8 to 10 in addition to the adjustment of the stitch coordinates of the base sewing.

Figure 14:
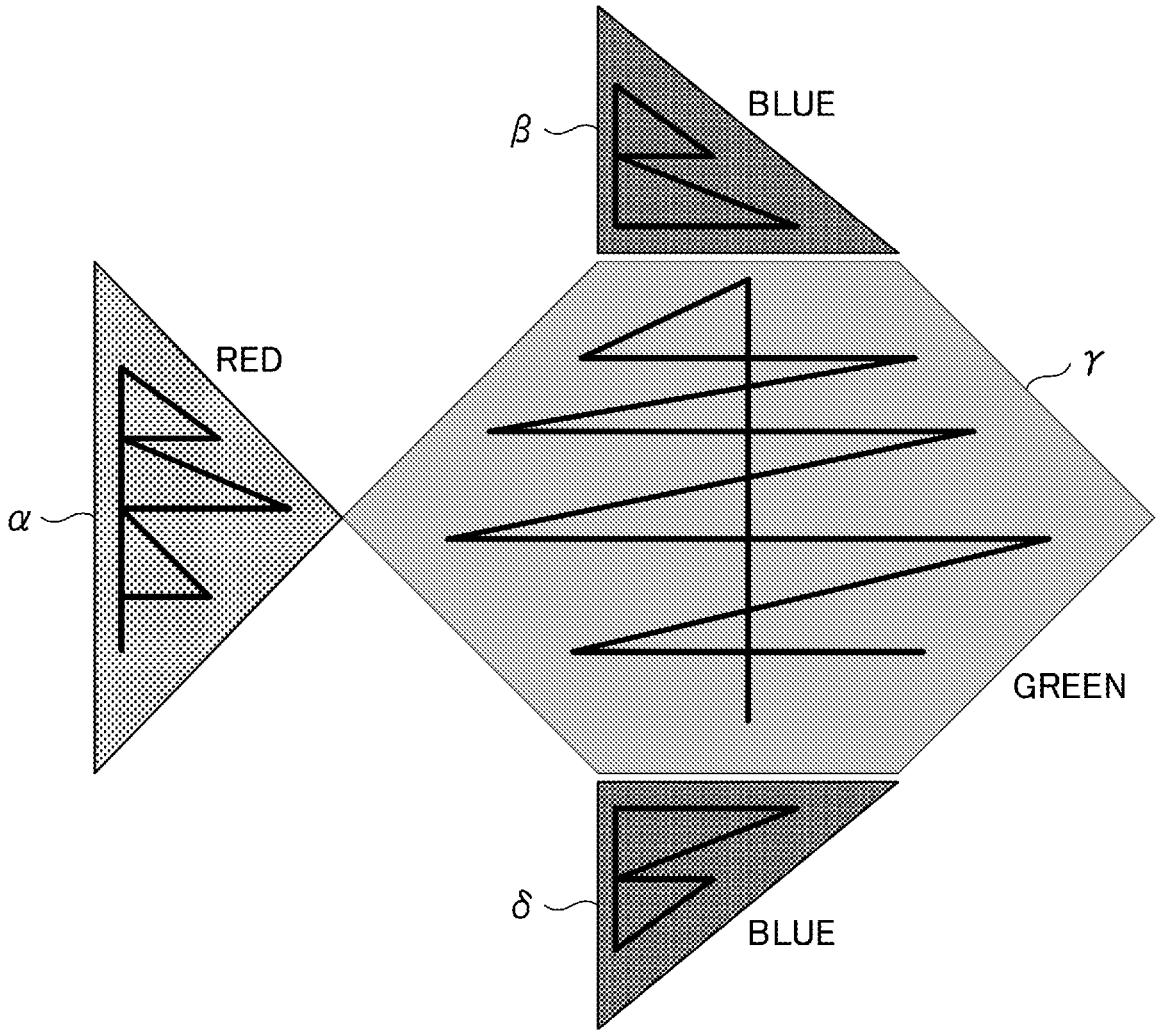
FIG. 14 illustrates an example of changing stitch coordinates of the base sewing as a correction embroidery condition according to the first embodiment of the present invention.

Here, as an application example of correction by base sewing, the embroidery divided into a plurality of regions as illustrated in FIG. 14 is assumed. FIG. 14 illustrates an example where a plurality of color regions are embroidered as a correction embroidery condition, and the stitch coordinates of the base sewing are changed.

In each region, the black portions represent the base sewing, and the thread is dyed in the order α→β→γ→δ, and the embroidery is performed in this order. The regions to be filled include, for example, α that is red, β that is blue, γ that is green, and δ that is blue.

Then, the embroidery is performed in the following order. (1) Base sewing of region α→(2) pattern sewing of region α→(3) base sewing of region β→(4) pattern sewing of region β→(5) base sewing of region γ→(6) pattern sewing of region γ→(7) base sewing of region δ→(8) pattern sewing of region δ. The base sewing is usually performed with a white thread.

When the consumed needle thread is longer than the originally set length when embroidering the region in step (2), the thread will become insufficient. Therefore, the white thread for base sewing in the region β, in step (3) will be mixed into the thread that is supposed to be dyed to a blue color in the embroidery of the pattern sewing in the region β, in the next step (4).

Therefore, when performing base sewing in the region β, in of step (3), when the thread consumption amount is already high at the time point of step (2), in the base sewing in the region β, in of step (3), the position (stitch coordinates) where the needle 11 is inserted is changed, to reduce the amount of thread used in the base sewing in the region β, of step (3), thereby adjusting the thread consumption amount.

On the other hand, when the consumed needle thread is shorter than the originally set length, in the base sewing of the next step, the position (stitch coordinates) where the needle 11 is inserted is changed to increase the thread amount used for base sewing, thereby adjusting the consumption amount of the thread.

Here, the amount of thread consumed is much higher for the pattern sewing for filling the region, than for the base sewing. Therefore, in the case of adjustment of the base sewing, the difference between the assumed thread consumption amount and the actual consumption amount is detected, at several tens of stitches before the end of the pattern sewing as the color change position. Then, the initial embroidery data is replaced by data in which the width of embroidery (stitch length) is changed, in the subsequent step of base sewing.

In this control operation, the pattern sewing is positioned on the frontmost side and the base sewing is hidden under the pattern sewing, and, therefore, the starting point of (4), the starting point of (6), and the starting point of (8), which are the time points of switching from the base sewing to the pattern sewing, are considered to be the future time points t2β, t2γ, and t2δ, which are the assumed color change positions. The number of stitches in the base sewing is small, and, therefore, the time points t1α, t1β, and t1γ for detecting the difference in the consumption amount, which are several tens of stitches before the time points t2β, t2γ, and t2δ, correspond to the execution period of pattern sewing in the previous colored area.

In this control operation, in each of the total of steps (1)+(2)+(3), the total of steps (4)+(5), and the total of steps (6)+(7), which are the region in which the colored dyeing and the white color are combined, the stitches of the base sewing are adjusted so that the actual cumulative consumption amount of the thread at the future time points t2β', t2γ', and t2δ' when the color is actually changed, is the same as the cumulative assumed consumption amount of the thread at the assumed future time points t2β, t2γ, and t2δ.

Thus, by adjusting the amount of thread for the base sewing, in each region, the starting position of the pattern sewing, which is the actual color change position of the continuous thread, can be aligned with the color change position in the embroidery image.

(Correction Example 5)

Further, although not illustrated, when there is a surplus of the needle thread N, the consumption amount of the needle thread may be increased by consuming the surplus thread for purposes other than the originally intended embroidery. The consumption of the thread for purposes other than the originally intended embroidery includes consuming the thread by (1) embroidering the surplus thread outside the region of the originally intended embroidery, (2) cutting the thread after embroidering outside the region of the originally intended embroidery, and (3) winding up and cutting the surplus thread. In this method also, the length of the thread to the color change position can be adjusted (increased) to prevent color shift of the thread.

(Second Control Example)

Figure 15:
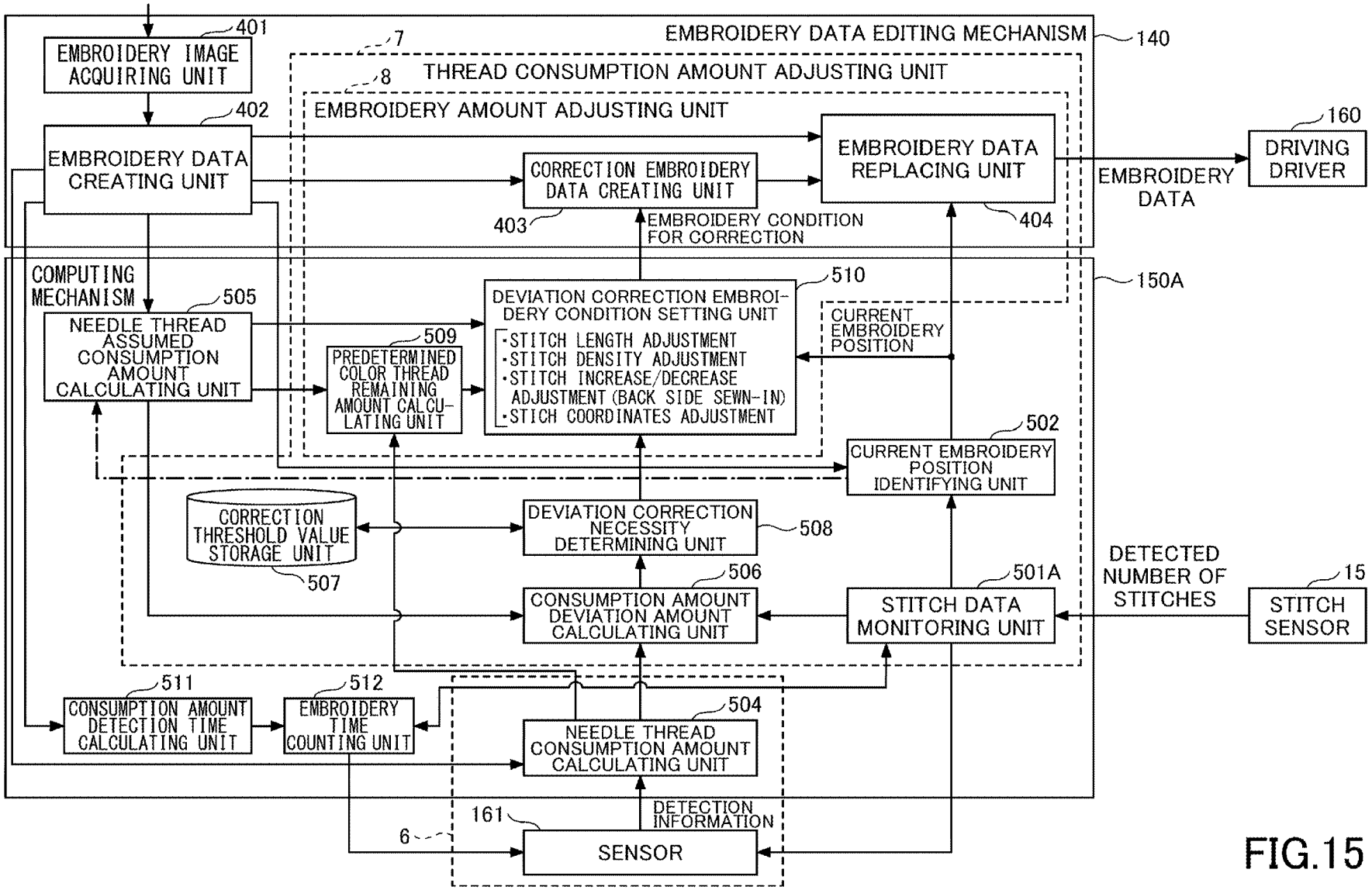
FIG. 15 is a functional block diagram of an embroidery data editing mechanism and a computing mechanism of a second control example according to the first embodiment of the present invention.

FIG. 15 is a functional block diagram of an embroidery data editing mechanism and a computing mechanism according to the second control example of the first embodiment. In the above-described first control example, the predetermined number of stitches before the color change position, at which the cumulative consumption amount of thread needs to be detected, is identified by counting the number of stitches. However, in the second control example, the predetermined number of stitches before the color change position is identified by counting the embroidery time. Only the differences from FIG. 6 are described below.

In an embroidery apparatus capable of executing the present control example, a constant speed mode in which the operation of each stitch is performed at a constant speed, can be set. In the constant speed mode, the user can specify a driving speed (rpm) in the needle up-and-down driving unit 181 to specify how many times the needle is lowered within a predetermined time. The driving speed is a parameter in which the rpm is related to the productivity. As the driving speed becomes faster, the tension on the needle thread becomes high, such that the embroidery picture is easily impaired and the thread is easily cut, but the embroidery can be sewn quickly.

In a constant speed mode, basically, embroidery is performed at this specified driving speed rpm. Therefore, in such a constant speed mode, it is possible to determine which stitch is sewn at what time before performing the sewing, from the embroidery data. However, when the position where the needle is lowered suddenly becomes far off, the speed is switched to a reasonable speed within the embroidery apparatus 1. For example, the speed is switched internally on the machine side to prevent the needle from bending. In this case, the speed information is fed back.

In the present control example, in a computing mechanism 150A, instead of the consumption amount detection stitch number extracting unit 503, a consumption amount detection time calculating unit 511 and an embroidery time counting unit 512 are included.

On the basis of the initial embroidery data, the consumption amount detection time calculating unit 511 extracts the thread consumption amount up to the time point t1 that is several tens of stitches before the time point t2 at the position of the marking or the color boundary on the continuous needle thread N including a color change, and the stitch number corresponding to the consumption amount up to the position on the thread, and stores the time corresponding to the stitch number as a consumption amount detection time t1.

When there is a change in the speed of needle lowering, the stitch data monitoring unit 501 reports this to the embroidery time counting unit 512.

The embroidery time counting unit 512 counts the embroidery time, and when the embroidery time reaches the consumption amount detection time point t1, the embroidery time counting unit 512 sends a detection instruction to the sensor 161. When there is a change in the needle lowering speed, the embroidery time counting unit 512 counts the embroidery time upon applying the information relating to this change.

The sensor 161, which is a rotary encoder, detects the cumulative conveyance amount at the time point t1, as the needle thread consumption amount.

In the present control example, the subsequent computations are the same as in the first control example. According to the difference between the actual needle thread consumption amount detected by counting the embroidery time, and the assumed consumption amount of the needle thread associated with the time (the number of stitches) calculated from the input initial embroidery data, the embroidery condition is set with respect to the initial embroidery data to create the correction embroidery data, and embroidery is performed according to the correction embroidery data, thereby adjusting the consumption amount of the needle thread N.

Figure 16:
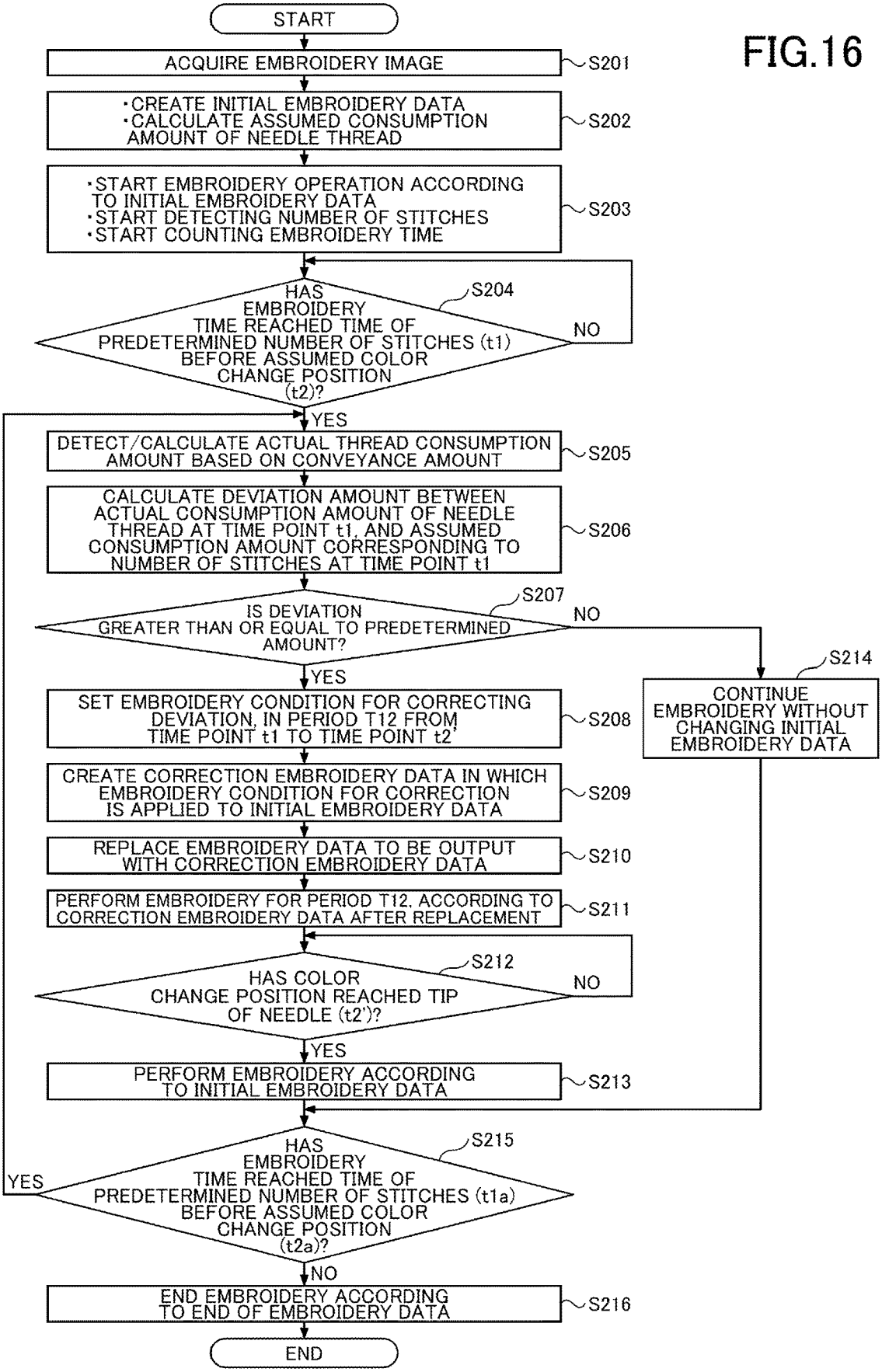
FIG. 16 is a flowchart of embroidery according to the second control example according to the first embodiment of the present invention.

FIG. 16 is a flowchart of embroidery according to a second control example according to the first embodiment. Only the differences from FIG. 7 are described below.

In this flow, in step S203, the number of stitches is detected and the embroidery time is counted.

In step S204 and step S215, when the counted embroidery time reaches a consumption amount detection time corresponding to a predetermined number of stitches before the color change position, in step S205, the thread consumption amount detection mechanism 6 detects and calculates the actual consumption amount of the needle thread N.

Then, in step S206, in the computing mechanism 150A, the actual consumption amount of the needle thread N detected and calculated using the embroidery time as a trigger in step S205, is compared with the assumed consumption amount of the needle thread associated with the number of stitches reached in step S204 in the assumed consumption amount calculated in step S202, and the deviation amount of the consumption amount is calculated. That is, in step S206, the actual thread consumption amount at the time point t1 (current time point) that is several tens of stitches before the (future) time point t2 when the color is assumed to change, is compared with the assumed thread consumption amount at the time point t1 (current time point).

In the present control example, the subsequent computations are the same as in the first control example. According to the deviation amount, when the deviation amount is greater than or equal to a threshold value, the embroidery condition is adjusted in the period (correction period) T12 from the detection time point t1 to the future time point t2', which is the actual color change position, and the embroidery data to be output is replaced with the correction embroidery data changed from the initial embroidery data. The embroidery conditions for correction are, similarly to the first control example, adjusting the sewing method from the initial embroidery data, for example, adjusting the stitch density (FIG. 8 and FIG. 9), adjusting the stitch length (FIG. 8 and FIG. 10), increasing and decreasing stitches (sewing in to the back side), adjusting the stitch coordinates of the base sewing (FIG. 13 and FIG. 14), or the like.

By such a control operation, also in the second control example, in the embroidery apparatus, when a continuous needle thread including a color change is used, the positional deviation of color caused by the deviation of the thread consumption amount in the embroidery apparatus, can be eliminated, even when the amount of the needle thread used is different from the assumed amount due to the difference in tension of the needle thread and the bobbin thread or the like.

(Third Control Example)

Figure 17:
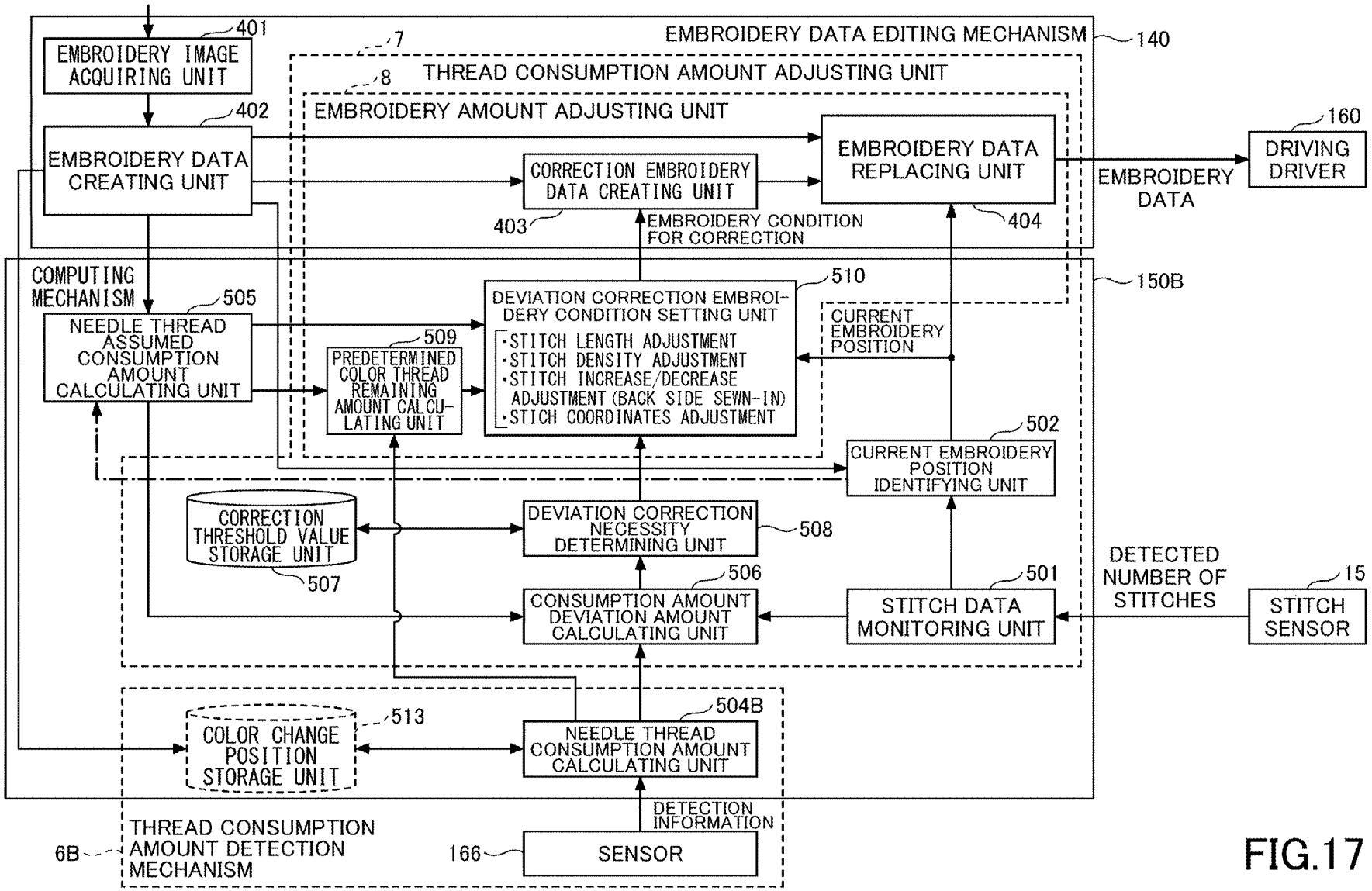
FIG. 17 is a functional block diagram of an embroidery data editing mechanism and a computing mechanism of a third control example according to the first embodiment of the present invention.

FIG. 17 is a functional block diagram of the embroidery data editing mechanism and the computing mechanism of the third control example according to the first embodiment. The third control example is a control example in which the optical sensor 166 illustrated in FIGS. 5(*b*) and (*c*) is used as a sensor of the consumption amount detection mechanism. Only the differences from the first and second control examples will be described below.

In the third control example, the sensor that performs detection to calculate the needle thread consumption amount, is not given an instruction of the detection timing from outside, but the needle thread consumption amount is calculated at the time point when the optical sensor 166 detects the color change position or marking.

Accordingly, in the present control example, an instruction of the timing is not input to the optical sensor 166, and the computing mechanism 150B includes a color change position storage unit 513 for referencing the color change position detected by the optical sensor 166. In this configuration, the sensor 166 (the needle thread detecting unit 16B), a needle thread consumption amount calculating unit 504B, and the color change position storage unit 513 configure the thread consumption amount detection mechanism 6B.

In the present control example, the sensor 166 detects when the color change position or the marker position reaches the sensor position facing the sensor 166 and transmits time information of the detection timing (t1) to the needle thread consumption amount calculating unit 504B.

The color change position storage unit 513 stores the distance from the position of the starting point to the color change position or the distance from the previous color change position to the current color change position.

The needle thread consumption amount calculating unit 504B (thread consumption amount calculating unit) calculates the actual consumption amount of the needle thread N on the basis of the detection timing when detection is performed by the sensor 166 and information in the color change position storage unit 513. For example, the needle thread consumption amount calculating unit 504B calculates the actual needle thread consumption amount at the time point t1 (current time) that is several tens of stitches before the time point t2 when the color is assumed to change, corresponding to a distance D illustrated in FIG. 19.

Figure 18:
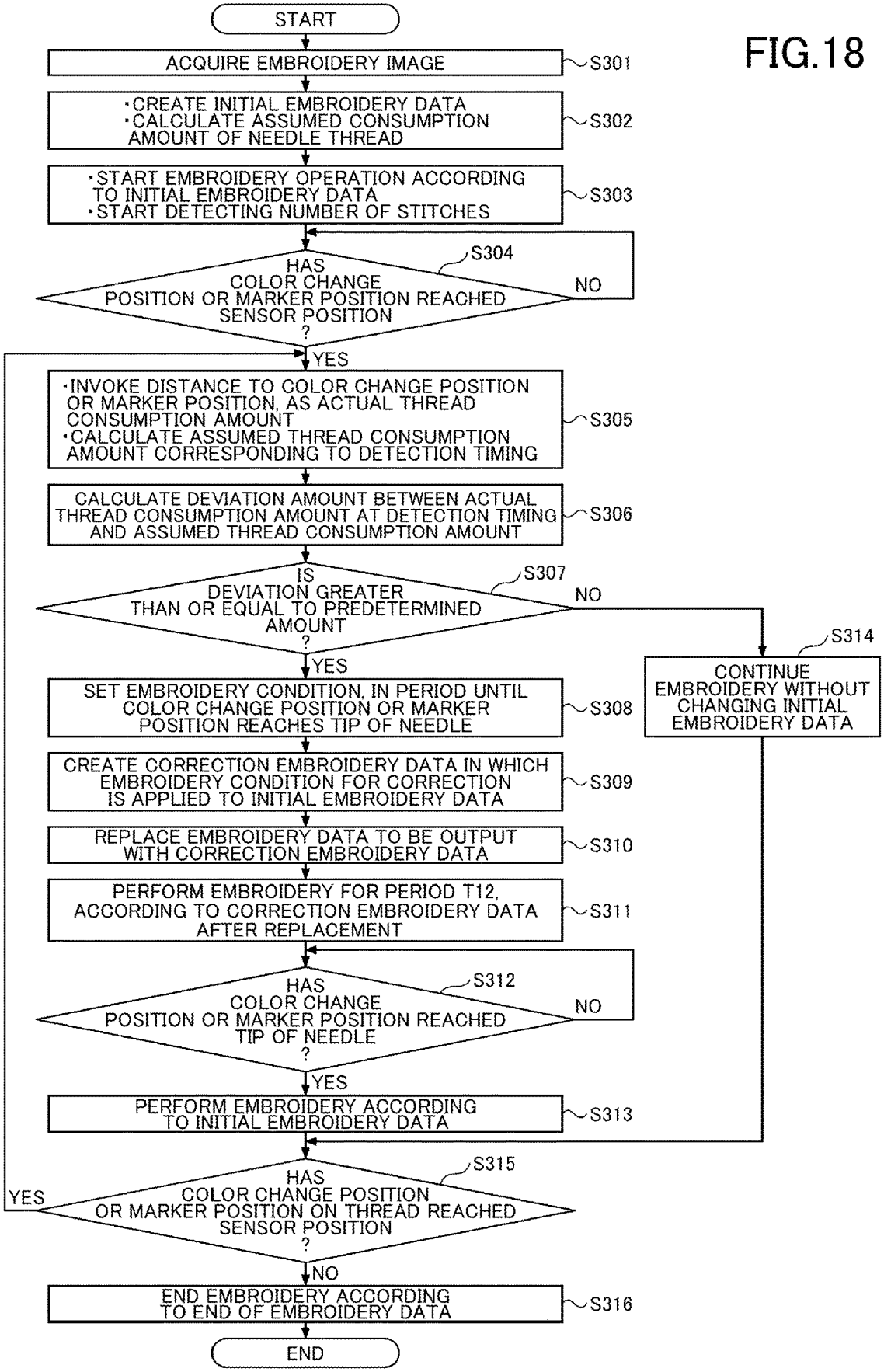
FIG. 18 is a flowchart of embroidery according to the third control example according to the first embodiment of the present invention.

FIG. 18 is a flowchart of embroidery according to the third control example according to the first embodiment of the present invention. The optical sensor 166 applied to the third control example detects the timing (time information) by detecting the change in the color of the needle thread N as described above, and, therefore, detection cannot be performed at a timing when the color does not change. Therefore, the method for calculating the thread consumption amount using the sensor detection information is different from the flow illustrated in FIG. 7.

In this flow, at step S304, when a color change position or a marker position reaches a position facing the optical sensor 166, the color change position or the marker position is detected at this timing (t1).

Figure 19:
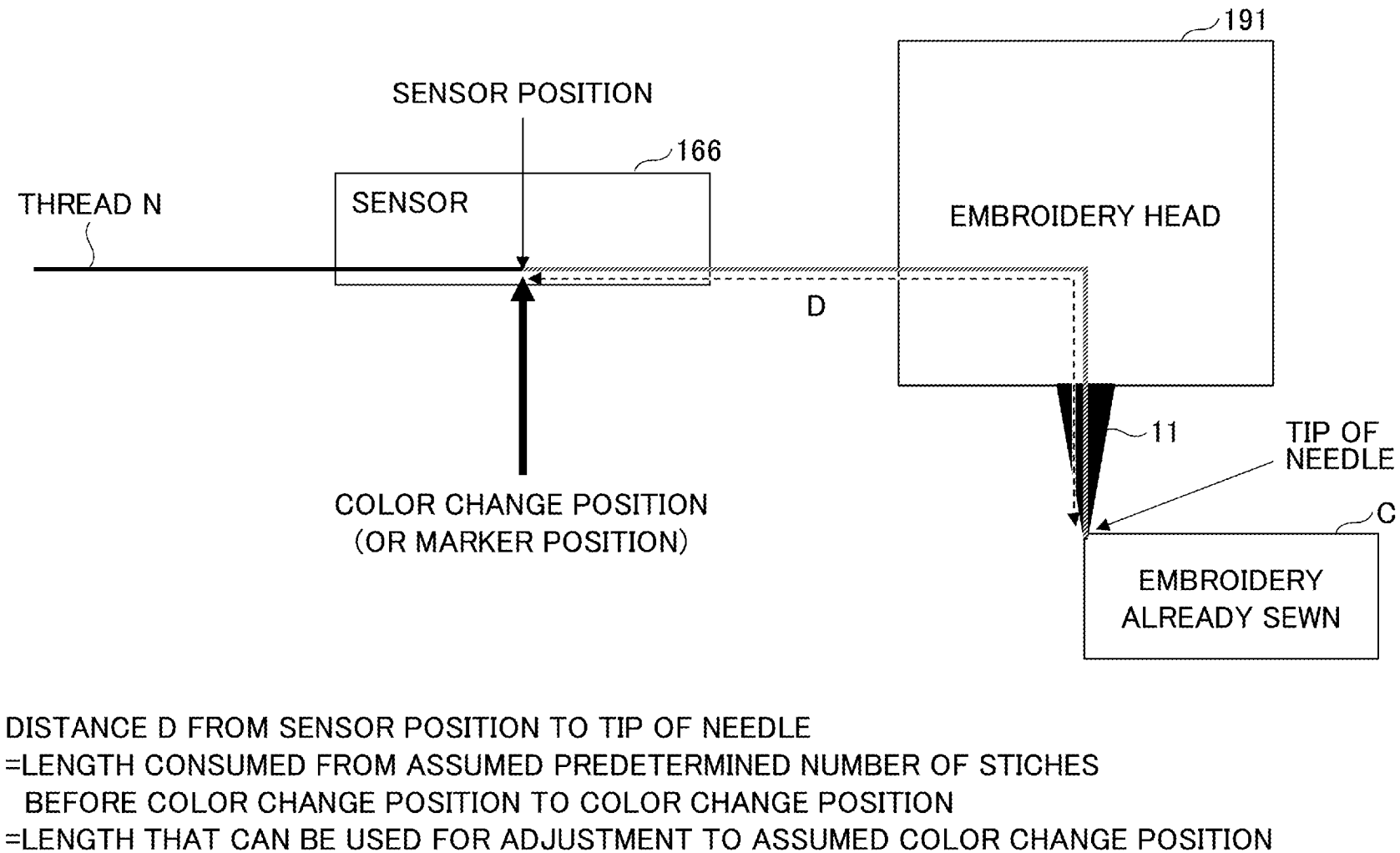
FIG. 19 illustrates the distance from the sensor position of an optical sensor to the tip of the needle in the third control example according to the first embodiment of the present invention.

Here, FIG. 19 illustrates an explanatory view of the sensor position of the optical sensor 166 and the distance to the tip of the needle 11 in the third control example. In the present control example, as illustrated in FIGS. 8 to 14, the timing just before (for example, several tens of stitches before) the color change position reaches the cloth C (the tip of the needle 11), is the assumed timing when the color change position or the marker position of the needle thread N reaches the sensor position of the optical sensor 166. Therefore, in the present control example, a distance D from the sensor position to the tip of the needle 11 is the length of thread that can be used to adjust the embroidery up to the assumed color change position, that is, the length of the thread that is assumed to be consumed by a predetermined number of stitches (several tens of stitches).

In the first control example and the second control example, the detection timing is a timing that is a predetermined number of stitches before the assumed color change, that is, a timing that is fixed according to the time. However, in the present control example, as illustrated in FIG. 19, the distance D from the sensor position to the tip of the needle 11 is fixed, and, therefore, the detection timing is a timing according to a fixed distance and a varying time, in which the distance from the starting position or the previous color change position to the current color change position is fixed.

Therefore, when the thread consumption amount is high and the conveyance speed is fast, the detection timing when the color change position or the marker position reaches the sensor position is reached earlier than predicted, and when the thread consumption amount is low and the conveyance speed is slow, the timing of reaching the sensor position is later than predicted.

In step S305, the needle thread consumption amount calculating unit 504B invokes, from the color change position storage unit 513, the distance of the thread from the starting point to the color change position or the marker position, and outputs (calculates) the invoked value as the actual thread consumption amount at the detection timing. In parallel, the needle thread assumed consumption amount calculating unit 505 calculates the assumed consumption amount at the detection timing using the detection timing, the actual embroidery position, and the initial embroidery data.

In step S306, the deviation amount between the actual thread consumption amount and the assumed consumption amount at the detection timing is calculated. Then, in step S307, when the deviation amount calculated in step S306 is greater than or equal to a predetermined amount, the process proceeds to step S308, and when the deviation amount is less than a predetermined amount, the process proceeds to step S314 to continue embroidery with the unchanged initial embroidery data.

In step S308, the embroidery condition is set in order to correct the deviation amount in the computing mechanism 150B. In this example also, adjustment is made so that the color change position actually reaches the tip of the needle 11 at the actual timing (t2') at which the color change position reaches the tip of the needle 11.

In the present example, as illustrated in FIG. 19, the length of thread that can be used for adjustment up to the assumed color change position is the length of the thread from the sensor position to the tip of the needle 11. Therefore, the time (T12) that can be used for adjustment is the period from when the actual color change position or the marker position reaches the sensor position to when the actual color change position or the marker position reaches the tip of the needle.

When the actual thread consumption amount is less than predicted, the color change position or marker position will slowly reach the sensor position, and, therefore, the length of the thread that can be used for adjustment up to the actual color change position is longer than the distance D, and thus adjustment is made to increase the consumption amount. On the other hand, when the actual thread consumption amount is larger than predicted, the color change position or the marker position will quickly reach the sensor position, and, therefore, the length that can be used for adjustment up to the actual color change position is shorter than the distance D, and thus adjustment is made to decrease the consumption amount. By this control operation, in the dye region of the predetermined color before the color changes on the thread, the actual cumulative consumption amount of the thread of the predetermined color at the time point t2' when the color actually changes, is adjusted so as to be the same as the cumulative assumed consumption amount of the thread of the predetermined color at the time point t2 when the color is assumed to change.

Then, in step S309, the correction embroidery data is created by applying the correction embroidery condition to the initial embroidery data, and in step S310, the embroidery data for output is replaced by the correction embroidery data and the correction embroidery data is output, and in step S311, the embroidery is performed according to the embroidery data (the correction embroidery data) after replacement, until the actual color change position on the thread reaches the tip of the needle 11 in step S312.

In step S312, when the timing at which the actual color change position on the thread reaches the tip of the needle 11 is reached, in step S313, the embroidery data to be output is returned to the initial embroidery data and embroidery is performed.

Then, in step S315, when the next color change position or marker position reaches the sensor position facing the optical sensor 166, the next color change position or marker position is detected at this timing. Then, the calculation of the consumption amount and the adjustment of the embroidery data in steps S305 to S314 are performed. In calculating the actual consumption amount using the second and subsequent detection results, the distance of the thread between the color change position or the marker position of the previous time (step S304) and the color change position or the marker position of the current time (step S315) is invoked, to calculate the actual thread consumption amount at the detection timing.

Then, the calculation of the consumption amount and the adjustment of the embroidery data of steps S305 to S314 are performed. The embroidery is performed according to the embroidery data (initial embroidery data or the correction embroidery data) until the embroidery data is completed in step S316, and when all the embroidery data is completed in step S316, the embroidery in the embroidery apparatus 1 is ended.

Also in this control operation, in order to set the embroidery condition for correction such as increase/decrease of the embroidery density and the width of the embroidery, addition of the sewing into the backside, adjustment of the coordinate positions of the stitches for base sewing, and the like, the actual usage amount is detected immediately before the color change, the deviation from the prediction is calculated, and adjustment is made in real-time to replace the embroidery data, thereby adjusting thread consumption amount used for the embroidery is adjusted by real-time. By such a control, in the embroidery apparatus 1, when a continuous needle thread including a color change is used, the positional deviation of color caused by the deviation in the consumption amount in the embroidery apparatus can be eliminated, even when the amount of the needle thread used is different from the assumed amount.

Second Embodiment

Figure 20:
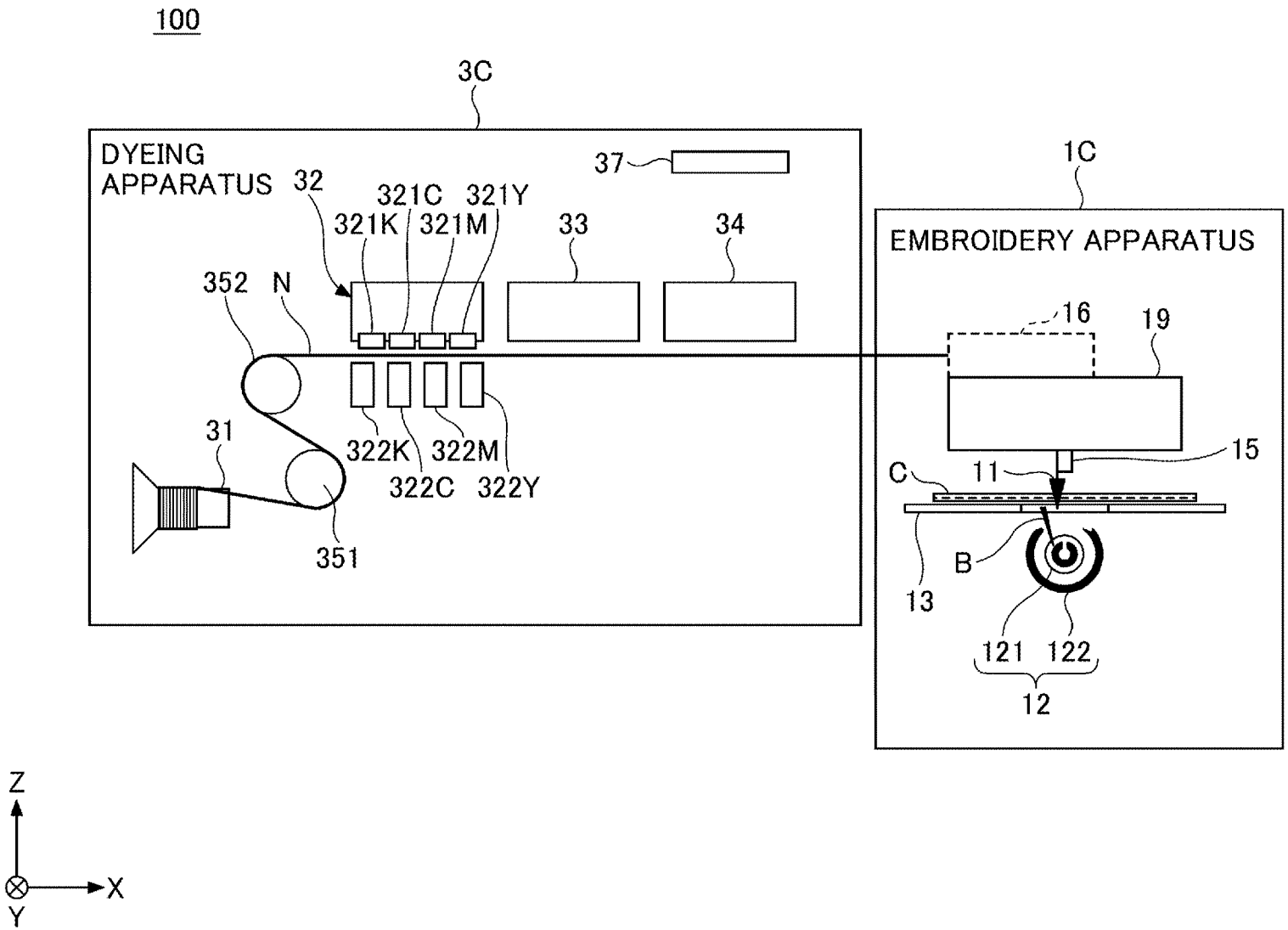
FIG. 20 is a side schematic view of a dyeing/embroidery system according to a second embodiment of the present invention.

FIG. 20 is a side schematic view of a dyeing/embroidery system 100 according to a second embodiment of the present invention. In this system, a dyeing apparatus 3C for applying varying colors in the conveying direction onto a needle thread unwound from a needle thread reel, is provided at the front stage of an embroidery apparatus 1C.

In the present embodiment, a needle thread reel 31 is provided in the dyeing apparatus 3C at the upstream side in the conveying direction, instead of being provided in the embroidery apparatus 1C.

Here, the dyeing apparatus 3C mainly includes the needle thread reel 31 around which the needle thread N is wound, a dyeing unit 32, a fixing unit 33, and a post-processing unit 34.

In the dyeing apparatus 3C, the needle thread N drawn from the needle thread reel 31 is guided by rollers 351 and 352 and is continuously extended around the rollers through the dyeing unit 32 so as to reach the embroidery apparatus 1C.

The dyeing unit 32 includes a plurality of heads 321 (321K to 321Y) for discharging and applying liquid of the required color to the needle thread N that is drawn out from the needle thread reel 31 and conveyed, and a plurality of individual maintenance units 322 (322K to 322Y) for maintaining each of the heads 321.

The plurality of heads 321K to 321Y are discharging heads that discharge different colors from each other. For example, the head 321K discharges droplets (ink) of black (K), the head 321C discharges droplets of cyan (C), the head 321M discharges droplets of magenta (M), and the head 321Y discharges droplets of yellow (Y).

The order of the colors is an example and the colors may be arranged in a different order from this description. In this example, the heads 321K to 321Y of four colors are provided. However, in an embodiment of the present invention, a continuous needle thread is to be dyed with a plurality of varying colors in the conveying direction, so any number of heads may be used as long as there are heads corresponding to at least two or more colors. Although not illustrated, the dyeing unit 32 may include a discharging head at the most downstream side for discharging colorless droplets for coating the dyed needle thread, or may include a discharging head at the most upstream side for discharging colorless droplets for coating the dyed needle thread.

Further, the maintenance units 322K to 322Y are provided at the lower side of the heads 321K to 321Y of each color. As the maintenance and recovery operations performed by the maintenance units 322K to 322Y, the heads are capped when not in use, idle discharging of droplets from the head 321 are received, and the nozzles undergo a suction and circulation operation in a state where the idle discharge receiver is brought close to the head, and the nozzles are wiped.

The dyeing unit 32 of the dyeing apparatus 3C illustrated in FIG. 20 indicates an example of a configuration of a liquid discharge method in which the needle thread N is dyed by discharging ink from the head 321. However, the dyeing unit 32 may be of an application method in which ink is applied by sandwiching the needle thread N with a roller or the like.

The fixing unit 33 performs a fixing process (drying process) of fixing the ink discharged from the dyeing unit 32 on the needle thread N. The fixing unit 33 includes heating means such as infrared irradiation means and hot air blowing means, for example, and heats and dries the needle thread N.

The post-processing unit 34 includes, for example, cleaning means for cleaning the needle thread N, lubricant applying means for applying lubricant to the surface of the needle thread N, and the like.

In the dyeing apparatus 3C according to an embodiment of the present invention, it will suffice as long as at least the dyeing unit 32 for applying colored liquid to the needle thread N is provided, and the fixing unit 33 and the post-processing unit 34 may not be provided.

The dyeing apparatus 3C also includes a computing mechanism 37 for controlling the dyeing. The computing mechanism 37 is electrically connected to the computing mechanism on the side of the embroidery apparatus 1C, creates dye data including information relating to the color and the dyeing length with respect to the needle thread N based on the embroidery image acquired by the embroidery apparatus 1C, and outputs the data to the dyeing unit 32. Then, the dyeing unit 32 dyes the needle thread N by a color and a dyeing length corresponding to the dye data.

Third Embodiment

Figure 21:
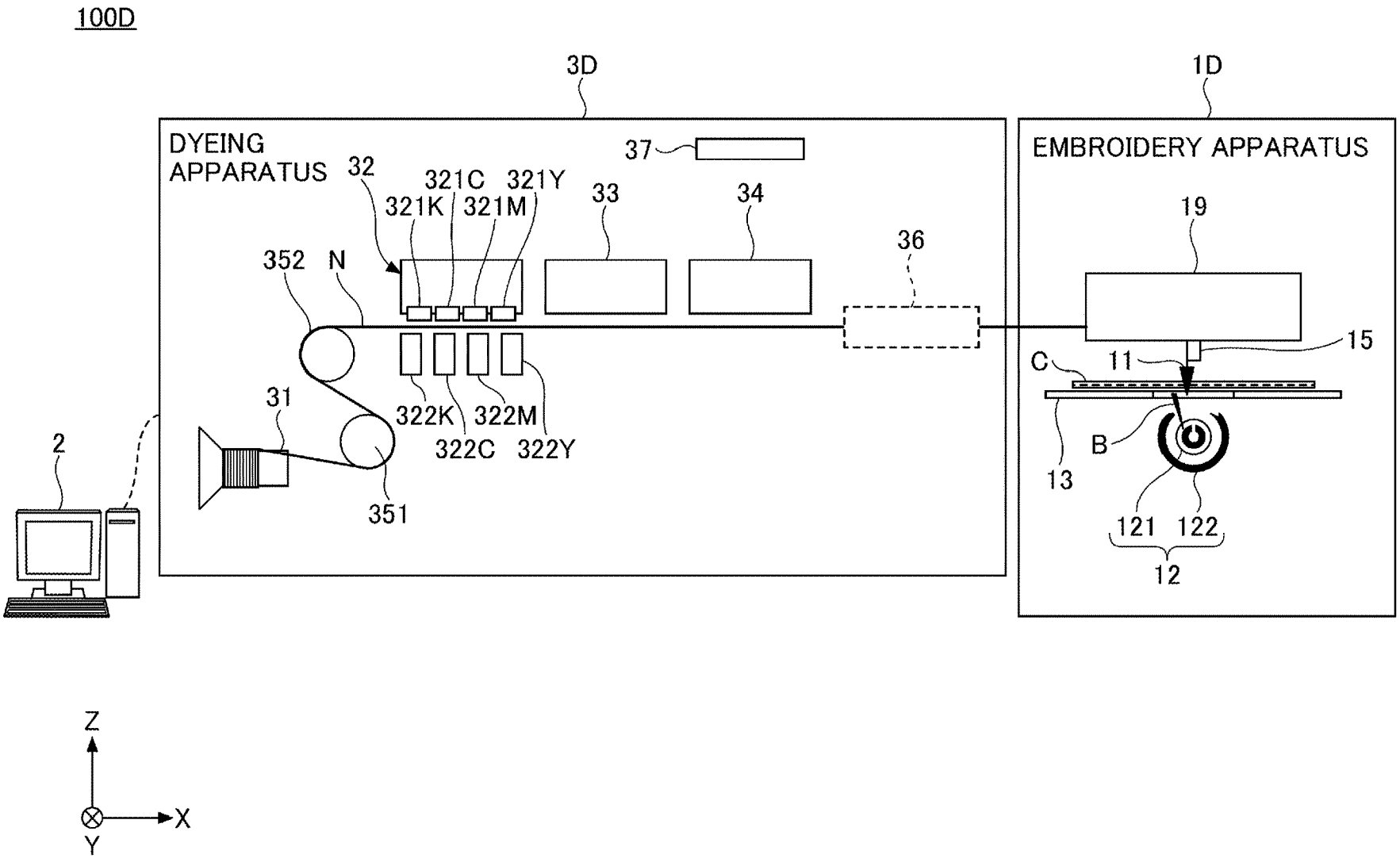
FIG. 21 is a side schematic view of a dyeing/embroidery system according to a third embodiment of the present invention.

FIG. 21 is a side schematic view of a dyeing/embroidery system according to a third embodiment of the present invention. In the present embodiment, an upper level control apparatus 2, which is an upper level apparatus, is connected to a dyeing/embroidery system 100D. The upper level control apparatus 2 is an information processing apparatus such as a computer.

In the system according to the present embodiment, a needle thread detecting unit 36 in the speed detecting mechanism is provided in a dyeing apparatus 3D, instead of being provided in an embroidery apparatus 1D. The detecting units 16 and 36 of the consumption amount detection mechanism according to an embodiment of the present invention may be mounted in either the dyeing apparatus or an embroidery apparatus, as illustrated in FIGS. 20 and 21.

FIG. 22 is a functional block diagram illustrating the control portion of the upper level control apparatus 2, the dyeing apparatus 3D, and the embroidery apparatus 1D according to the third embodiment. Descriptions of the same portions as those in FIG. 7 are omitted.

In the present embodiment, a part of the function of the computing mechanism 150 of the embroidery apparatus 1 illustrated in FIG. 7 is implemented by a computing unit 220 of the upper level control apparatus 2.

In the present embodiment, a computing mechanism 150D of the embroidery apparatus 1D includes, in an executable manner, a stitch data monitoring unit 501 and a current embroidery position identifying unit 502 that are involved in the actual embroidery execution.

The upper level control apparatus 2 includes an embroidery data editing unit 210, the computing unit 220, and a dye data creating unit. The embroidery data editing unit 210 has substantially the same function as the embroidery data editing mechanism 140 of FIG. 7.

The computing unit 220 includes a consumption amount detection stitch number extracting unit 221, a needle thread consumption amount calculating unit 222, a needle thread assumed consumption amount calculating unit 223, a consumption amount deviation amount calculating unit 224, a correction threshold value storage unit 225, a deviation correction necessity determining unit 226, a predetermined color thread remaining amount calculating unit 227, and a deviation correction embroidery condition setting unit 228 in an executable manner.

The dyeing apparatus 3D includes a computing mechanism 37 including a dye control unit 371 and a sensor 361 (366). The sensor 361 (366) is a sensor having the same function as the sensor 161 (166) of the consumption amount detection mechanism illustrated in FIG. 5.

In the present embodiment, the sensor 361 (366), the consumption amount detection stitch number extracting unit 221 of the upper level control apparatus 2, and the needle thread consumption amount calculating unit 222 function as a thread consumption amount detection mechanism 6D for detecting the amount of actual consumption amount of the needle thread. FIG. 22 illustrates a functional block diagram of a case in which control similar to that of the first control example is performed. However, in the case in which control similar to that of the second control example is performed, a consumption amount detection time calculating unit and a consumption time counting unit are provided in the upper level control apparatus 2. In the case in which control similar to that of the third control example is performed, a color change position storage unit is provided in the upper level control apparatus 2.

Further, according to the present embodiment, in the upper level control apparatus 2, the consumption amount deviation amount calculating unit 224, the correction threshold value storage unit 225, the deviation correction necessity determining unit 226, the predetermined color thread remaining amount calculating unit 227, the deviation correction embroidery condition setting unit 228, an embroidery data correcting unit 213, and an embroidery data replacing unit 214 function as a thread consumption amount adjusting unit 7D. In the thread consumption amount adjusting unit 7D, the predetermined color thread remaining amount calculating unit 227, the deviation correction embroidery condition setting unit 228, the embroidery data correcting unit 213, and the embroidery data replacing unit 214 function as an embroidery amount adjusting unit 8D.

Note that, in an embodiment of the present invention, the needle thread assumed consumption amount calculating unit 505 (223) and the thread consumption amount adjusting unit 7 (7D) may be mounted in any one of the dyeing apparatus, the embroidery apparatus, or the upper level control apparatus capable of being connected to the dyeing/embroidery system.

In the present embodiment, in the upper level control apparatus 2, the initial embroidery data is replaced with the correction embroidery data and the correction embroidery data is output for a period of time up to the color change position, by referring to the created initial embroidery data and the detection stitch data created by the embroidery apparatus 1D or the current embroidery position data identified from the embroidery status.

In a configuration in which a dyeing apparatus for performing on-demand printing on a needle thread is provided as in the second embodiment and the third embodiment, the dyeing position of the thread needs to be aligned with the embroidery position, so in the dyeing apparatus 3 (3D), dyeing is performed in accordance with the initial embroidery data. However, after the dyeing, when a deviation occurs in the tension difference between the needle thread and the bobbin thread in the embroidery apparatus 1C (1D), the consumption amount of the needle thread is deviated from the predicted amount and a positional deviation occurs. However, in this control operation, the sewing method itself in the embroidery operation is adjusted by editing the initial embroidery data so that the remaining thread amount is appropriately consumed by a precise amount up to the color change position. Therefore, it is possible to eliminate the positional deviation of the embroidery which occurs after dyeing.

According to one embodiment of the present invention, in an embroidery apparatus, it is possible to eliminate the positional deviation of the color of embroidery on a cloth during the embroidery operation, even when the actual thread consumption amount is deviated from the assumed amount, when a continuous thread including a color change is used.

The embroidery apparatus, the dyeing/embroidery system, and the method for adjusting the consumption amount of thread are not limited to the specific embodiments described in the detailed description, and variations and modifications may be made without departing from the spirit and scope of the present invention.

What is claimed is:

1. An embroidery apparatus configured to perform an embroidery operation on a cloth according to embroidery data, the embroidery apparatus comprising:

an assumed thread consumption amount calculator configured to calculate an assumed thread consumption amount of a thread in the embroidery operation based on initial embroidery data input in advance;

a thread consumption amount detection mechanism configured to detect an actual thread consumption amount of the thread in the embroidery operation; and a thread consumption amount adjuster configured to adjust the actual thread consumption amount by adjusting the initial embroidery data based on a difference between the assumed thread consumption amount and the actual thread consumption amount, and output adjusted embroidery data to a driver that drives and controls a drive motor of the embroidery apparatus, wherein the thread consumption amount detection mechanism includes an optical detection sensor configured to detect a color change of the thread at a detection time t1; and a thread consumption amount calculator, a distance from a detection position, at which the optical detection sensor detects the color change, to a tip of a needle is set as an estimated stitching distance covered by a predetermined number of stitches, the optical detection sensor detects an actual color change position at the detection position, the thread consumption amount calculator invokes a fixed distance from a starting position to the actual color change position detected by the optical detection sensor, and sets the fixed distance as the actual consumption amount of the thread, and the assumed thread consumption amount calculator calculates the assumed thread consumption amount at the detection time t1, the assumed thread consumption amount being calculated from data indicating a number of stitches that have progressed in the embroidery operation, and a position in the initial embroidery data corresponding to the indicated number of stitches.

2. The embroidery apparatus according to claim 1, wherein the embroidery apparatus performs the embroidery operation on the cloth using a needle thread passed through the needle and a bobbin thread that is fed according to the needle thread being fed, the thread consumption amount detection mechanism detects the actual thread consumption amount of the needle thread, the assumed thread consumption amount calculator calculates the assumed consumption amount of the needle thread, and the thread consumption amount adjuster adjusts the actual consumption amount of the needle thread based on the difference between the assumed thread consumption amount of the needle thread and the actual thread consumption amount of the needle thread.

3. The embroidery apparatus according to claim 1, wherein the thread consumption amount detection mechanism includes:

a conveyed thread amount sensor provided on a roller that rotates with the thread being, conveyed thereon, the conveyed thread amount sensor being configured to detect a cumulative conveyed thread amount of the thread; and a thread consumption amount calculator, wherein the conveyed thread amount sensor detects the cumulative conveyed thread amount at a time point corresponding to a predetermined number of stitches before a time point when the color change of the thread is assumed to occur, and the thread consumption amount calculator calculates the actual thread consumption amount based on the cumulative conveyed thread amount.

4. The embroidery apparatus according to claim 1, wherein the thread consumption amount adjuster includes:

a thread consumption amount deviation amount calculator configured to calculate a difference between the actual thread consumption amount and the assumed thread consumption amount at a time point t1, the time point t1 corresponding to a predetermined number of stitches before a time point t2 at which the color change of the thread is assumed to occur; and an embroidery amount adjuster configured to adjust the embroidery operation on the cloth, by changing the output embroidery data from the initial embroidery data to the adjusted embroidery data, in a period T12 from the time point t1 to a time point t2' corresponding to the actual color change position, based, on the difference between the actual thread consumption amount and the assumed thread consumption amount, such that an actual cumulative consumption amount of the thread of a predetermined color at the time point t2' corresponding to the actual color change position becomes the same as a cumulative assumed thread, consumption amount of the thread of the predetermined color at the time point t2 when the color change of the thread is assumed to occur, in a dye region of the predetermined color before the color change occurs in the thread.

5. The embroidery apparatus according to claim 4, wherein the time point t1, corresponding to the predetermined number of stitches before the time point t2, is detected by counting the number of stitches.

6. The embroidery apparatus according to claim 4, wherein when the embroidery operation is performed in a constant speed mode, the time point t1 is detected by counting an embroidery time.

7. The embroidery apparatus according to claim 1, wherein the thread consumption amount adjuster includes:

a thread consumption deviation amount calculator configured to calculate a difference between the actual thread consumption amount and the assumed thread consumption amount at the detection timing time point t1 of the actual color change position detected by the thread consumption amount detection mechanism; and an embroidery amount adjuster configured to adjust the embroidery operation on the cloth, by changing the output embroidery data from the initial embroidery data to the adjusted embroidery data, in a period T12 from the detection timing time point t1 to a time point t2' corresponding to an actual color change position, based on the difference between the detected actual thread consumption amount and the assumed thread consumption amount, such that an actual cumulative consumption amount of the thread of a predetermined color at the time point t2' corresponding to the actual color change position becomes the same as a cumulative assumed consumption amount of the thread of the predetermined color at a time point t2 when color change of the thread is assumed to occur, in a dye region of the predetermined color before color change occurs in the thread.

8. The embroidery apparatus according to claim 4, wherein the embroidery amount adjuster sets an embroidery condition to increase a consumption rate of the thread in the period T12 in response to determining that the actual thread consumption is less than the assumed consumption of the thread at the time point t1, and sets an embroidery condition to decrease the consumption rate of the thread in the period T12 in response to determining that the actual thread consumption is greater than or equal to the assumed consumption of the thread at the time point t1.

9. The embroidery apparatus according to claim 4, wherein the embroidery amount adjuster sets, as the output embroidery data, the adjusted embroidery data in which a length of a stitch in the initial embroidery data is changed, in the period T12 from the time point t1 to the time point t2' corresponding to the actual color change position.

10. The embroidery apparatus according to claim 4, wherein the embroidery amount adjuster sets, as the output embroidery data, the adjusted embroidery data in which a density of sewing the thread is changed from that of the initial embroidery data, in the period T12 from the time point t1 to the time point t2' corresponding to the actual color change position.

11. The embroidery apparatus according to claim 4, wherein the embroidery amount adjuster sets, as the output embroidery data, the adjusted embroidery data in which a stitch that is not originally input is added to the initial embroidery data or part of the initial embroidery data is deleted, in the period T12 from the time point t1 to the time point t2' corresponding to the actual color change position.

12. The embroidery apparatus according to claim 4, wherein the embroidery amount adjuster sets, as the output embroidery data, the adjusted embroidery data that is adjusted so as to increase a consumption of the thread by consuming the thread in a region outside an intended embroidery region and then cutting the thread, or winding the thread and, then cutting the thread, in the period T12 from the time point t1 to the time point t2' corresponding to the actual color change position.

13. A dyeing/embroidery system including a dyeing apparatus configured to dye a needle thread that is fed from the dyeing apparatus; and an embroidery apparatus configured to perform an embroidery operation on a cloth according to embroidery data using the need thread and a bobbin thread that is fed according to the needle thread being fed, the dyeing/embroidery system comprising:

a thread consumption amount detection mechanism configured to detect an actual thread consumption amount of the needle thread in the embroidery operation;

an assumed thread consumption amount calculator configured to calculate an assumed thread consumption amount of the needle thread, based on initial embroidery data input in advance; and a thread consumption amount adjuster configured to adjust the actual thread consumption amount by adjusting the initial embroidery data based on a difference between the assumed thread consumption amount and the actual thread consumption amount of the thread, and output adjusted embroidery data to a driver that drives and controls a drive motor of the embroidery apparatus, wherein the dyeing apparatus includes a dyer configured to apply changing colors to the needle thread in a conveying direction of the needle thread;

the thread consumption amount detection mechanism is mounted in the dyeing apparatus or the embroidery apparatus; and the assumed thread consumption amount calculator and the thread consumption amount adjuster are mounted in the dyeing apparatus, in the embroidery apparatus, or in an upper level control apparatus configured to be connected to the dyeing/embroidery system, the thread consumption amount detection mechanism includes an optical detection sensor configured to detect a color change of the thread at a detection time t1 and a thread consumption amount calculator, a distance from a detection position, at which the optical detection sensor detects the color change, to a tip of a needle is set as an estimated stitching distance covered by a predetermined number of stitches, the optical detection sensor detects an actual color change position at the detection position, the thread consumption amount calculator invokes a fixed distance from a starting position to the actual color change position detected by the optical detection sensor, and sets the fixed distance as the actual consumption amount of the thread, and the assumed thread consumption amount calculator calculates the assumed thread consumption amount at the detection time t1, the assumed thread consumption amount being calculated from data indicating a number of stitches that have progressed in the embroidery operation, and a position in the initial embroidery data corresponding to the indicated number of stitches.

14. The dyeing/embroidery system according to claim 13, wherein the embroidery apparatus includes a stitch sensor configured to detect a number of stitches representing how many stitches are sewn by the needle.

15. A method for adjusting a consumption amount of a thread, the method being performed in an embroidery apparatus configured to perform an embroidery operation on a cloth according to embroidery data, the method, comprising:

calculating an assumed thread consumption amount of the thread in the embroidery operation based on initial embroidery data input in advance;

detecting an actual thread consumption amount of the thread in the embroidery operation;

adjusting the actual thread consumption amount by adjusting the initial embroidery data based on a difference between the assumed thread consumption amount and the actual thread consumption; and outputting adjusted embroidery data to a driver that drives and controls a drive motor of the embroidery apparatus, wherein the thread consumption amount detection mechanism includes an optical detection sensor configured to detect a color change of the thread at a detection time t1 and a thread consumption calculator, a distance from a detection position, at which the optical detection sensor detects the color change, to a tip of a needle is set as an estimated stitching distance covered by a predetermined number of stitches, the optical detection sensor detects an actual color change position at the detection position, the thread consumption amount calculator invokes a fixed distance from a starting position to the actual color change position detected by the optical detection sensor, and sets the fixed distance as the actual consumption amount of the thread, and the assumed thread consumption amount calculator calculates the assumed thread consumption amount at the detection time t1, the assumed thread consumption amount being calculated from data indicating a number of stitches that have progressed in the embroidery operation, and a position in the initial embroidery data corresponding to the indicated number of stitches.

* * * * *